US011466435B2

(12) United States Patent
Izumi et al.

(10) Patent No.: US 11,466,435 B2
(45) Date of Patent: Oct. 11, 2022

(54) HYDRAULIC EXCAVATOR WITH AREA LIMITING CONTROL FUNCTION

(71) Applicant: HITACHI CONSTRUCTION MACHINERY CO., LTD., Tokyo (JP)

(72) Inventors: Shiho Izumi, Hitachinaka (JP); Shuuichi Meguriya, Ishioka (JP); Ryuu Narikawa, Mito (JP); Kouji Ishikawa, Kasumigaura (JP); Tarou Akita, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 65 days.

(21) Appl. No.: 16/919,313

(22) Filed: Jul. 2, 2020

(65) Prior Publication Data

US 2020/0332497 A1 Oct. 22, 2020

Related U.S. Application Data

(63) Continuation of application No. 16/084,247, filed as application No. PCT/JP2017/007992 on Feb. 28, 2017, now abandoned.

(30) Foreign Application Priority Data

Jul. 6, 2016 (JP) ..... 2016-134399

(51) Int. Cl.
*E02F 9/22* (2006.01)
*F02D 29/02* (2006.01)
(Continued)

(52) U.S. Cl.
CPC ..... *E02F 9/2246* (2013.01); *E02F 3/43* (2013.01); *E02F 3/435* (2013.01); *E02F 9/20* (2013.01);
(Continued)

(58) Field of Classification Search
None
See application file for complete search history.

(56) References Cited

U.S. PATENT DOCUMENTS 5,968,104 A 10/1999 Egawa
6,169,948 B1 * 1/2001 Fujishima ..... E02F 3/435 701/50
(Continued)

FOREIGN PATENT DOCUMENTS

EP 0965698 A1 12/1999
JP 60-038561 A 2/1985
(Continued)

OTHER PUBLICATIONS

International Search Report of PCT/JP2017/007992 dated May 23, 2017.
(Continued)

*Primary Examiner* — Faris S Almatrahi
*Assistant Examiner* — Hongye Liang
(74) *Attorney, Agent, or Firm* — Mattingly & Malur, PC

(57) ABSTRACT

A work machine (1) having a controller (40) that can perform area limiting control, the work machine further includes a machine control ON/OFF switch (17) that alternatively selects an ON position permitting execution of the area limiting control and an OFF position prohibiting execution of the area limiting control. The controller (40) has an engine control section (63) that performs automatic idling control when a predetermined period of time (T1) has elapsed after a point in time when all of operation levers (1, 23) have attained a neutral state. The engine control section (63) is configured to execute the automatic idling control during when the switch (17) is in the OFF position and not to execute the automatic idling control during when the switch (17) is in the ON position.

3 Claims, 12 Drawing Sheets

(51) Int. Cl.

| | |
|---|---|
| ***E02F 3/43*** | (2006.01) |
| ***E02F 9/20*** | (2006.01) |
| *F02D 29/04* | (2006.01) |

(52) U.S. Cl.
CPC ..... *E02F 9/2004* (2013.01); *F02D 29/02* (2013.01); *E02F 9/2285* (2013.01); *E02F 9/2292* (2013.01); *E02F 9/2296* (2013.01); *F02D 29/04* (2013.01)

(56) References Cited

U.S. PATENT DOCUMENTS

| | | | | |
|---|---|---|---|---|
| 6,275,757 | B1 | 8/2001 | Watanabe | |
| 2013/0190994 | A1* | 7/2013 | Narazaki ..... | F02D 29/00 701/50 |
| 2015/0240445 | A1 | 8/2015 | Guo | |

FOREIGN PATENT DOCUMENTS

| | | | |
|---|---|---|---|
| JP | 10-252092 | A | 9/1998 |
| JP | 2010-065577 | A1 | 3/2010 |
| JP | 2016-061084 | A | 4/2016 |

OTHER PUBLICATIONS

International Preliminary Report on Patentability received in corresponding International Application No. PCT/JP2017/007992 dated Jan. 17, 2019.

* cited by examiner

HYDRAULIC EXCAVATOR WITH AREA LIMITING CONTROL FUNCTION

TECHNICAL FIELD

The present invention relates to a work machine.

BACKGROUND ART

Conventionally, in a work machine including a hydraulic excavator, there is performed control to fluctuate the engine speed in accordance with the operation and the machine body condition from the viewpoint of operability and fuel efficiency. For example, when a predetermined period of time has elapsed from the point in time when all the operation levers have attained a neutral state, it is determined that the machine is in a situation in which the operation is at rest, and there is executed control to reduce the engine speed to an engine speed lower than the engine speed set by a throttle lever (which, in the following, may be referred to as "low engine speed control" or "automatic idling control"), whereby high fuel efficiency is realized as proposed in a technique (see Patent Document 1).

PRIOR ART DOCUMENT

Patent Document

Patent Document 1: JP-1985-38561-A

SUMMARY OF THE INVENTION

Problem to be Solved by the Invention

On the other hand, the hydraulic excavator is sometimes equipped with a control system aiding the excavation operation of the operator. More specifically, it is a control system which when an excavation operation (e.g., arm crowding designation) is input via an operation device, there is executed a control to forcibly operate at least the boom cylinder of a plurality of hydraulic actuators (e.g., to extend the boom cylinder to forcibly perform the boom raising operation) such that the position of the toe portion of the work implement is maintained on the target surface and in an area above the target surface based on the positional relationship between the target surface and the toe portion of the work implement (e.g., the claw tip of the bucket). In the following, this kind of control is sometimes referred to as "area limiting control" or "machine control."

Here, a hydraulic excavator endowed with both functions of area limiting control and low engine speed control will be considered. In this hydraulic excavator, the forcible boom raising operation due to area limiting control is added as appropriate to the arm crowding operation due to the operator operation to realize an operation in which the bucket toe is drawn horizontally to the machine body side along the target surface (leveling operation), whereby a flat target surface is finished. In the formation of an accurate target surface through the finishing operation, the control accuracy of the work implement toe is very important. When, during the finishing operation by the hydraulic excavator, the operation is interrupted with the bucket toe situated in the vicinity of the target surface, and there continues a state for a predetermined time in which all the operation levers are neutral, the low engine speed control is started. When, after this, the operator performs the arm crowding operation by the operation lever to resume the finishing operation, the low engine speed control is canceled and the area limiting control is started. At this time, through the canceling of the low engine speed control, the engine speed starts to quickly increase from the low engine speed to a value set for the area limiting control. Halfway through the acceleration, the area limiting control is executed, so that the actuator speed fluctuates, and there is a fear of it becoming difficult to maintain the control accuracy of the work implement.

When the low engine speed control is thus exerted in the excavator operation in which area limiting control is performed, the engine speed varied so as to be different from normal, so that it becomes difficult to maintain the control accuracy of the work implement at the time of execution of the area limiting control, resulting in an increased fear of intrusion of the work implement under the target surface.

It is an object of the present invention to provide a work machine capable of executing low engine speed control and area limiting control, in which it is possible to prevent deterioration in the control accuracy of the area limiting control attributable to the low engine speed control.

Means for Solving the Problem

The present application includes a plurality of means for solving the above problem, an example of which is a work machine including: an engine; a hydraulic pump driven by the engine; a multi-joint type work implement; a plurality of hydraulic actuators driving the work implement by a hydraulic working fluid delivered from the hydraulic pump; a plurality of operation levers outputting operation signals to the plurality of hydraulic actuators; and a controller which when excavation operation is input from an operator via the plurality of operation levers, performs area limiting control to control the plurality of hydraulic actuators such that an operational range of the work implement is limited to an area on a predetermined target surface and an area above the predetermined target surface. There is provided a switching device alternatively selecting between a permission position where execution of the area limiting control by the controller is permitted and a prohibition position where execution of the area limiting control is prohibited. The controller is equipped with an engine control section which when a predetermined period of time has elapsed from a point in time when all the plurality of operation levers have attained a neutral state, performs low engine speed control to make an engine speed of the engine a low engine speed that is lower than a control engine speed. In a case where the switching device is switched to the prohibition position, the engine control section executes the low engine speed control when the predetermined period of time has elapsed from the point in time when all the plurality of operation levers have attained a neutral state, and in a case where the switching device is switched to the permission position, the engine control section does not execute the low engine speed control even when the predetermined period of time has elapsed from the point in time when all the plurality of operation levers have attained a neutral state.

Effect of the Invention

According to the present invention, in a situation where control accuracy is required of the area limiting control, the low engine speed control is not executed, so that it is possible to suppress speed fluctuation of the actuators, and to maintain control accuracy at the time of the area limiting control.

MODES FOR CARRYING OUT THE INVENTION

Figure 1:
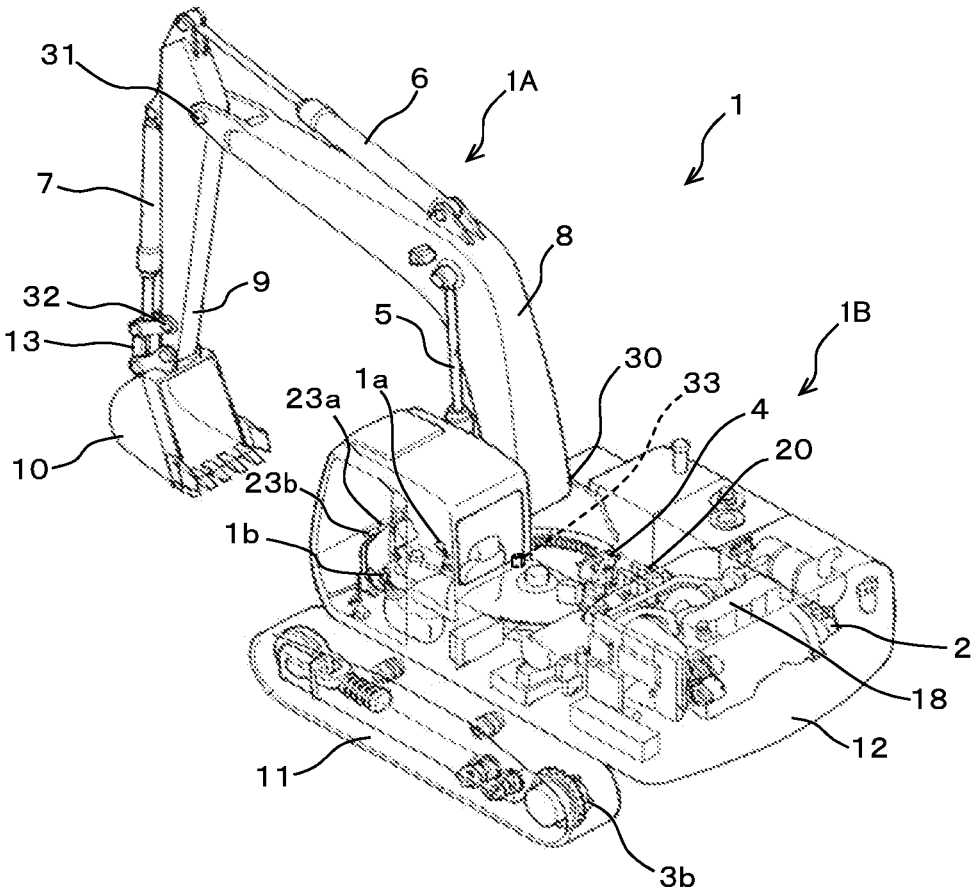
FIG. 1 is a diagram illustrating the structure of a hydraulic excavator according to a first embodiment of the present invention.

In the following, embodiments of the present invention will be described with reference to the drawings. While in the example described below a hydraulic excavator equipped with a bucket 10 as the attachment at the toe of the work implement is taken, the present invention is also applicable to a hydraulic excavator equipped with an attachment other than the bucket. Further, the present invention is applicable to a work machine other than a hydraulic excavator so long as it has a multi-joint work implement formed by connecting a plurality of driven members (an attachment, an arm, a boom, etc.) and configured to operate in a predetermined operational plane.

Further, in the following description, in the case where there exists a plurality of same components, a letter may be added to the reference numeral (number). In some cases, the letter may be omitted, with the plurality of components being collectively written. For example, when there exist three pumps 300*a*, 300*b*, and 300*c*, they may be collectively expressed as pumps 300.

First Embodiment

Figure 2:
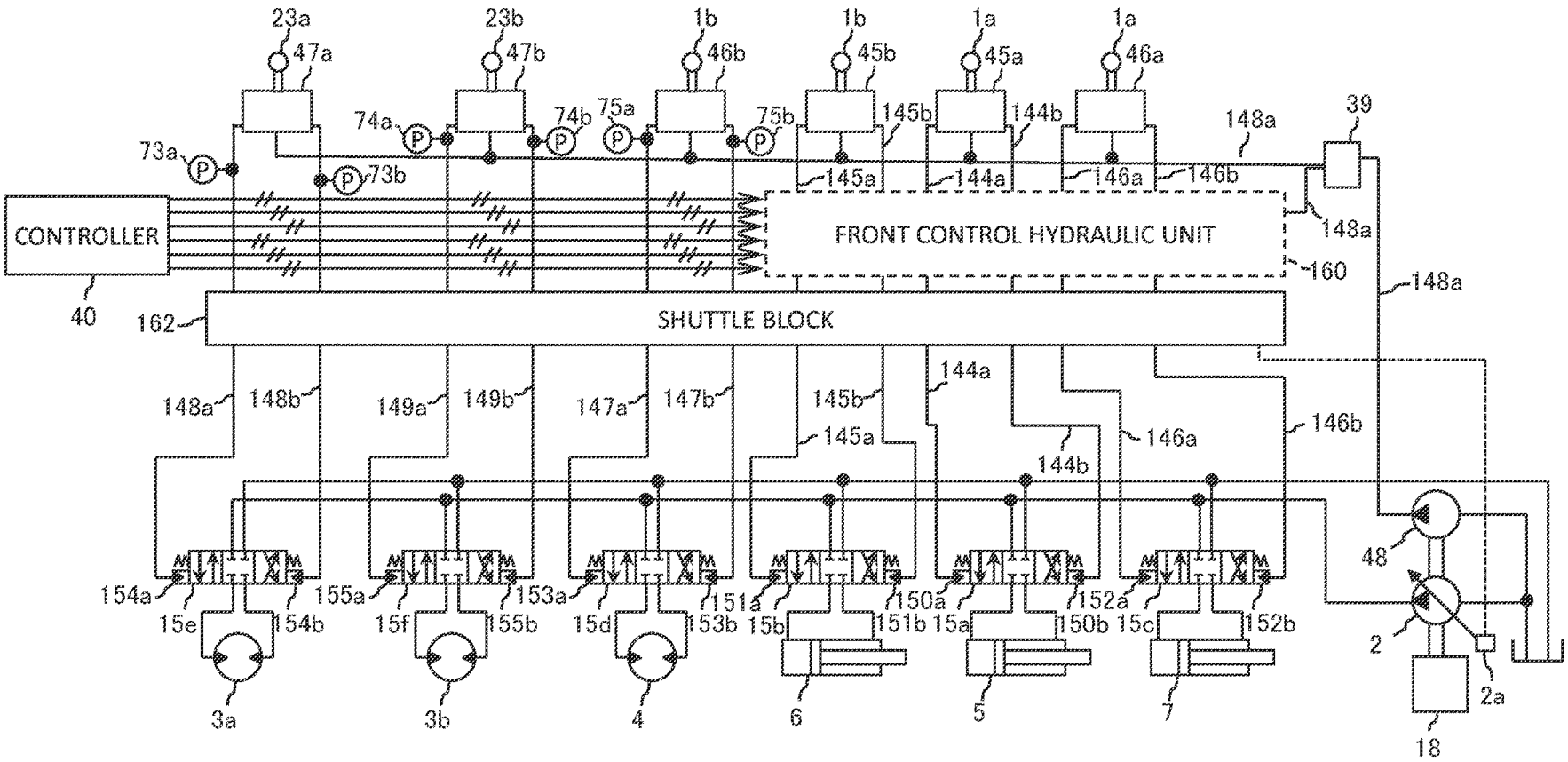
FIG. 2 is a diagram illustrating a controller of the hydraulic excavator of FIG. 1 along with a hydraulic drive system.
Figure 3:
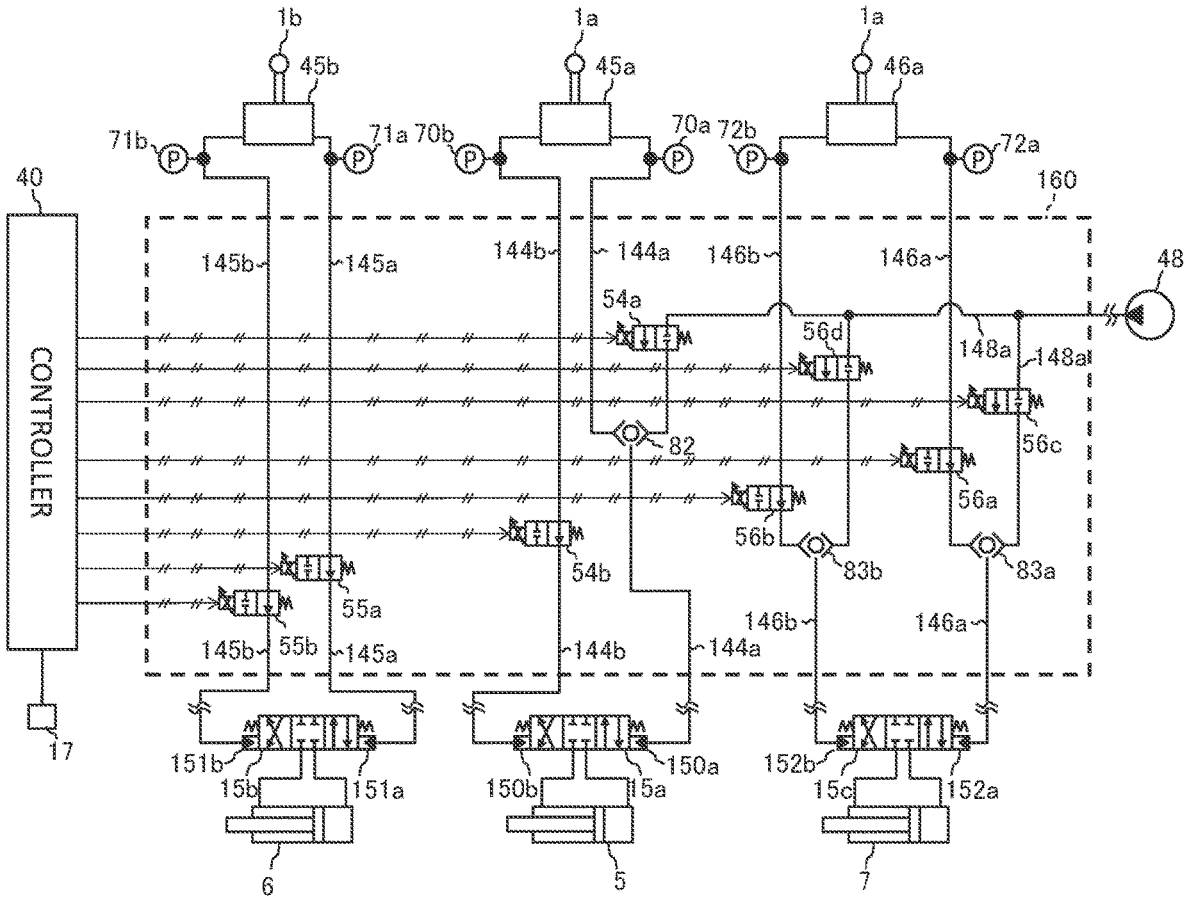
FIG. 3 is a detailed view of a front control hydraulic unit 160 in FIG. 2.

FIG. 1 is a diagram illustrating the structure of a hydraulic excavator according to a first embodiment of the present invention, FIG. 2 is a diagram illustrating a controller of the hydraulic excavator according to the first embodiment of the present invention along with a hydraulic drive system, and FIG. 3 is a detailed view of a front control hydraulic unit 160 in FIG. 2.

In FIG. 1, a hydraulic excavator 1 is composed of a front work implement 1A and a machine body 1B. The machine body 1B is composed of a lower track structure 11 tracking by left and right track motors 3*a* and 3*b* and an upper swing structure 12 swingably mounted on top of the lower track structure 11. The front work implement 1A is formed by connecting together a plurality of driven members (a boom 8, an arm 9, and a bucket 10) each rotating in the vertical direction, and the proximal end of the boom 8 of the front work implement 1A is supported by the front portion of the upper swing structure 12.

An engine 18, which is a prime mover mounted in the upper swing structure 12, drives a hydraulic pump 2 and a pilot pump 48. The hydraulic pump 2 is a variable displacement pump the capacity of which is controlled by a regulator 2*a*, and the pilot pump 48 is a fixed displacement pump. In the present embodiment, a shuttle block 162 is provided at some midpoint of pilot lines 144, 145, 146, 147, 148, and 149. Hydraulic signals output from operation devices 45, 46, and 47 are also input to the regulator 2*a* via this shuttle block 162. Although a detailed description of the structure of the shuttle block 162 is left out, a hydraulic signal is input to the regulator 2*a* via the shuttle block 162, and the delivery flow rate of the hydraulic pump 2 is controlled in accordance with the hydraulic signal.

A pump line 148*a*, which is delivery piping of the pilot pump 48, passes a lock valve 39, and then branches off into a plurality of lines to be connected to the operation devices 45, 46, and 47, and the valves in a front control hydraulic unit 160. In the present example, the lock valve 39 is a solenoid selector valve, and a solenoid drive section thereof is electrically connected to a position sensor for a gate lock lever (not shown) arranged in the cab (FIG. 1). The position of the gate lock lever is detected by the position sensor, and a signal corresponding to the position of the gate lock lever is input to the lock valve 39 from the position sensor. When the gate lock lever is at the locking position, the lock valve 39 is closed, and the pump line 148*a* is interrupted. When it is at the lock canceling position, the lock valve 39 is opened and the pump line 148*a* is opened. That is, in the state in which the pump line 148*a* is interrupted, the operation by the operation devices 45, 46, and 47 is nullified, and the operation such as swinging or excavating is prohibited.

The boom 8, the arm 9, the bucket 10, and the upper swing structure 12 constitute the driven members driven by the boom cylinder 5, the arm cylinder 6, the bucket cylinder 7, and the swing hydraulic motor 4. The operational designation to these driven members 8, 9, 10, and 12 is output through operator operation of a traveling right lever 23*a*, a traveling left lever 23*b*, an operation right lever 1*a*, and an operation left lever 1*b* (these are sometimes generally referred to as the operation levers 1 and 23) mounted in the cab on the upper swing structure 12.

Installed in the cab are an operation device 47*a* having the traveling right lever 23*a*, an operation device 47*b* having the traveling left lever 23*b*, operation devices 45*a* and 46*a* sharing the operation right lever 1*a*, and operation devices 45*b* and 46*b* sharing the operation left lever 1*b*. The operation devices 45, 46, and 47 are of the hydraulic pilot type. Based on the hydraulic fluid delivered from a pilot pump, they each generate a pilot pressure (sometimes referred to as the operation pressure) in accordance with the operation amounts (e.g., lever stroke) and operating directions of the operation levers 1 and 23 operated by the operator. The pilot pressure thus generated is supplied to hydraulic drive sections 150*a* through 155*b* of corresponding flow control valves 15*a* through 15*f* (see FIG. 2) in a control valve unit 20 via pilot lines 144*a* through 149*b* (see FIG. 2), and is utilized as a control signal driving these flow control valves 15*a* through 15*f*.

The hydraulic fluid delivered from the hydraulic pump 2 is supplied to a traveling right hydraulic motor 3*a*, a traveling left hydraulic motor 3*b*, a swing hydraulic motor 4, the boom cylinder 5, the arm cylinder 6, and the bucket cylinder 7 via the flow control valves 15*a*, 15*b*, 15*c*, 15*d*, 15*e*, and 15*f* (see FIG. 2). Due to the hydraulic fluid supplied, the boom cylinder 5, the arm cylinder 6, and the bucket cylinder 7 expand and contract, whereby the boom 8, the arm 9, and the bucket 10 rotate, and the position and posture of the bucket 10 are varied. Further, due to the hydraulic fluid supplied, the swing hydraulic motor 4 rotates, whereby the upper swing structure 12 swings with respect to the lower track structure 11. Further, due to the hydraulic fluid supplied, the traveling right hydraulic motor 3*a* and the traveling left hydraulic motor 3*b* rotate, whereby the lower track structure 11 travels.

On the other hand, in order that the rotational angles α, β, and γ (see FIG. 5) of the boom 8, the arm 9, and bucket 10 can be measured, a boom angle sensor 30 is mounted to a boom pin, an arm angle sensor 31 is mounted to an arm pin, and a bucket angle sensor 32 is mounted to a bucket link 13, and mounted to the upper swing structure 12 is a machine body inclination angle sensor 33 detecting the inclination angle θ in the front-rear direction (see FIG. 5) of the upper swing structure 12 (the machine body 1B) with respect to a reference surface (e.g., a horizontal surface).

The hydraulic excavator of the present embodiment is equipped with a control system aiding the excavation operation of the operator. More specifically, there is provided an excavation control system which when the excavation operation (more specifically, the designation of arm crowding, bucket crowding, or bucket damping) is input via the operation devices 45*b* and 46*a*, executes control to forcibly operate at least the boom cylinder 5 of the hydraulic actuators 5, 6, and 7 (e.g., to forcibly perform the boom raising operation by expanding the boom cylinder 5) such that the position of the toe portion of the work implement 1A is maintained on the target surface 60 or in the area above the target surface 60 based on the positional relationship between the target surface 60 (see FIG. 5) and the toe portion of the work implement 1A (the claw tip of the bucket 10 in the present embodiment. In the present specification, this control is sometimes referred to as "area limiting control" or "machine control." Due to this control, the claw tip of the bucket 10 is prevented from getting beyond the target surface 60, so that it is possible to perform excavation along the target surface 60 independently of the skill of the operator. In the present embodiment, the control point related to the area limiting control is set at the claw tip of the bucket 10 of the hydraulic excavator (the toe of the work implement 1A). The control point may be set at a point other than the bucket claw tip so long as it is a point at the toe portion of the work implement 1A. For example, it is also possible to select the bottom surface of the bucket 10 or the outermost portion of the bucket link 13.

This excavation control system capable of executing the area limiting control is equipped with a machine control ON/OFF switch 17 installed at a position not interrupting the field of vision of the operator such as a position above the operation panel in the cab and switching between effective and ineffective of the area limiting control, pressure sensors 70*a* and 70*b* (see FIG. 3) provided in the pilot lines 144*a* and 144*b* of the operation device 45*a* for the boom 8 and configured to detect a pilot pressure (control signal) as the operation amount of the operation lever 1*a*, a solenoid proportional valve 54*a* the primary port side of which is connected to the pilot pump 48 via the pump line 148*a* and which reduces and outputs the pilot pressure from the pilot pump 48 (see FIG. 3), a shuttle valve 82 (see FIG. 3) which is connected to the pilot line 144*a* of the operation device 45*a* for the boom 8 and the secondary port side of the solenoid proportional valve 54*a*, which selects the higher of the pilot pressure in the pilot line 144*a* and the control pressure output from the solenoid proportional valve 54*a*, and which leads to the hydraulic drive section 150*a* of the flow control valve 15*a*, a solenoid proportional valve 54*b* (see FIG. 3) installed in the pilot line 144*b* of the operation device 45*a* for the boom 8 and configured to reduce and output the pilot pressure in the pilot line 144*b* in accordance with the electric signal, and a controller (control section) 40 which is a computer capable of executing the area limiting control.

Respectively provided in the pilot lines 145*a* and 145*b* for the arm 9 are pressure sensors 71*a* and 71*b* (see FIG. 3) detecting the pilot pressure as the operation amount of the operation lever 1*b* and outputting it to the controller 40, and solenoid proportional valves 55*a* and 55*b* (see FIG. 3) reducing and outputting the pilot pressure based on the control signal from the controller 40.

Respectively provided in the pilot lines 146*a* and 146*b* for the bucket 10 are pressure sensors 72*a* and 72*b* (see FIG. 3) detecting the pilot pressure as the operation amount of the operation lever 1*a* and outputting it to the controller 40, solenoid proportional valves 56*a* and 56*b* (see FIG. 3) reducing and outputting the pilot pressure based on the control signal from the controller 40, solenoid proportional valves 56*c* and 56*d* (see FIG. 3) the primary port sides of which are connected to the pilot pump 48 and which reduce and output the pilot pressure from the pilot pump 48, and shuttle valves 83*a* and 83*b* (see FIG. 3) selecting the higher of the pilot pressure in the pilot lines 146*a* and 146*b* and the control pressure output from the solenoid proportional valves 56*c* and 56*d* and leading to the hydraulic drive sections 152*a* and 152*b* of the flow control valve 15*c*. In FIG. 3, the connection lines between the pressure sensors 70, 71, and 72 and the controller 40 are omitted for want of space.

In the front control hydraulic unit 160 constructed as described above, when the control signal is output from the controller 40 to drive the solenoid proportional valves 54*a*, 56*c*, and 56*d*, it is possible to generate the pilot pressure even when there is no operator operation of the operation devices 45*a* and 46*a*, so that it is possible to forcibly generate the boom raising operation, the bucket crowding operation, or the bucket damping operation. Similarly, when the solenoid proportional valves 54*b*, 55*a*, 55*b*, 56*a*, and 56*b* are driven by the controller 40, it is possible to reduce the pilot pressure generated through the operator operation of the operation devices 45*a*, 45*b*, and 46*a*, and it is possible to reduce the speed of the boom lowering operation, the arm crowding/damping operation, and the bucket crowding/damping operation more forcibly than in the operator operation.

Input to the controller 40 are the configuration information and positional information of the target surface 60 stored in a ROM 93 or a RAM 94 described below, the detection signals of angle sensors 30 through 32 and an inclination angle sensor 33, and the detection signals of pressure sensors 70 through 72. Further, the controller 40 outputs an electric signal correcting the control signal (pilot pressure) for performing the area limiting control to the solenoid proportional valves 54 through 56.

Figure 4:
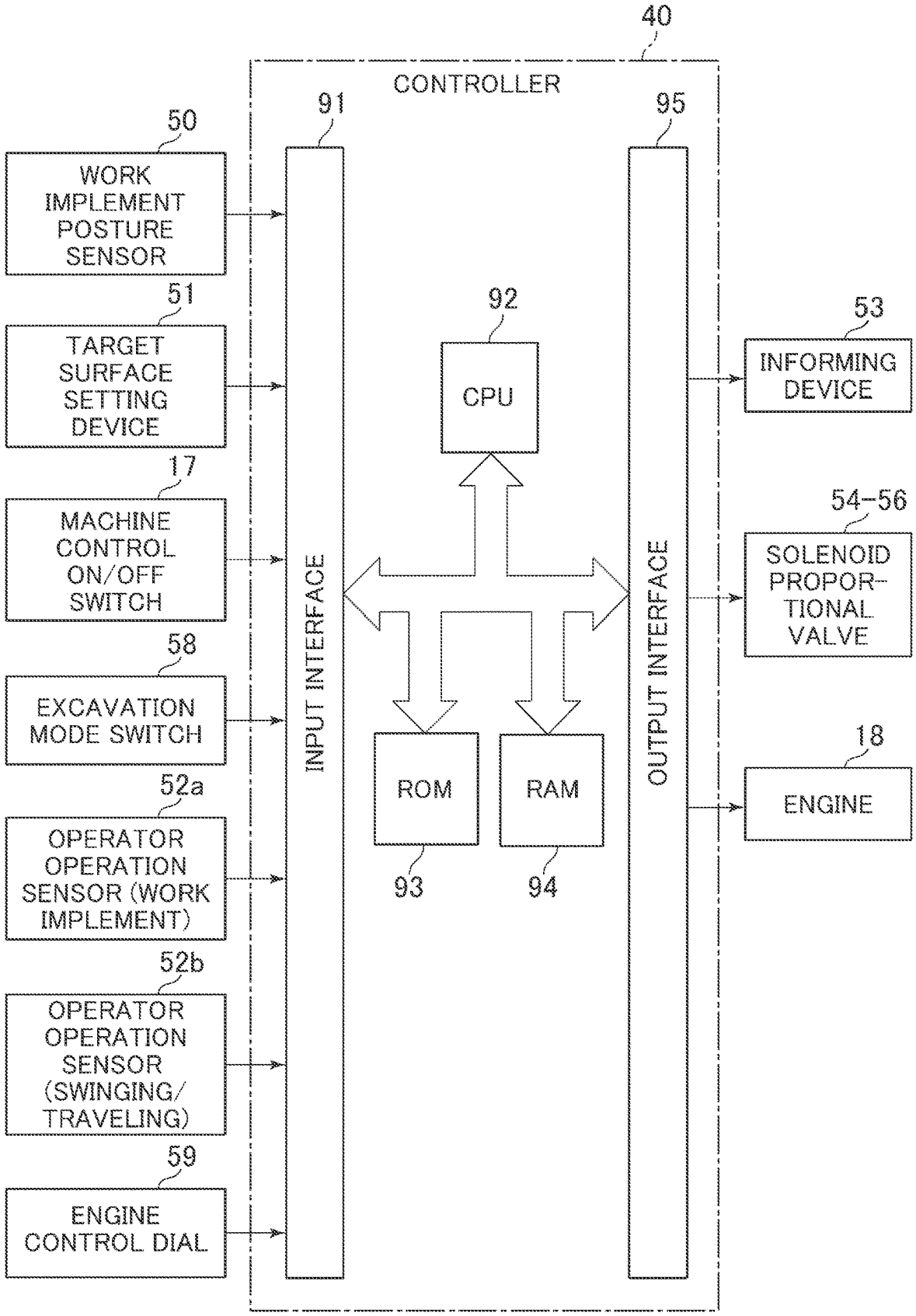
FIG. 4 is a diagram illustrating the hardware configuration of the controller of the hydraulic excavator of FIG. 1.

FIG. 4 shows the hardware configuration of the controller 40. The controller 40 has an input section 91, a central processing unit (CPU) 92 which is a processor, the read-only memory (ROM) 93 and the random-access memory (RAM) 94 which are storage devices, and an output section 95. The input section 91 inputs the signals from the angle sensors 30 through 32 and the inclination angle sensor 33 constituting a work implement posture sensor 50, a signal from a target surface setting device 51 which is a device for setting the target surface 60, the signal from the machine control ON/OFF switch 17, a signal from an excavation mode switch (mode selection device) 58 for selecting one excavation mode of which the execution during the area limiting control is desired by the operator from a plurality of modes, signals from the operator operation sensors 52*a* and 52*b* which are pressure sensors (including pressure sensors 70, 71, 72, 73, 74, and 75) detecting the operation amounts from the operation devices 45 through 47, and a signal from an engine control dial 59 to which an engine speed desired by the operator is input, and effects A/D conversion. The ROM 93 is a storage medium storing a control program for executing the area limiting control including the processing of flowcharts of FIGS. 10, 11, and 12 described below, and various items of information necessary for executing the flowcharts, and the CPU 92 performs predetermined computation processing on the signals taken in from the input section 91 and memories 93 and 94 in accordance with the control program stored in the ROM 93. The output section 95 prepares output signals in accordance with the computation result of the CPU 92, and outputs the signals to the solenoid proportional valves 54 through 56, an informing device 53, or an engine 18, whereby the hydraulic actuators 4 through 7 are driven/controlled, images of the machine body 1B, the bucket 10, the target surface 60, etc. are displayed on the display screen of a monitor which is the informing device 53, and the engine 18 is driven.

The informing device 53 is formed at least one of a display (display device) displaying the positional relationship between the target surface 60 and the work implement 1A to the operator, and a speaker informing the positional relationship between the target surface 60 and the work implement 1A through sound (including voice).

While the controller 40 of FIG. 4 is equipped with semiconductor memories ROM 93 and RAM 94 as the storage device, they may be replaced by some other device so long as it is a storage device. For example, a magnetic storage device such as a hard disk drive may be provided.

Figure 6:
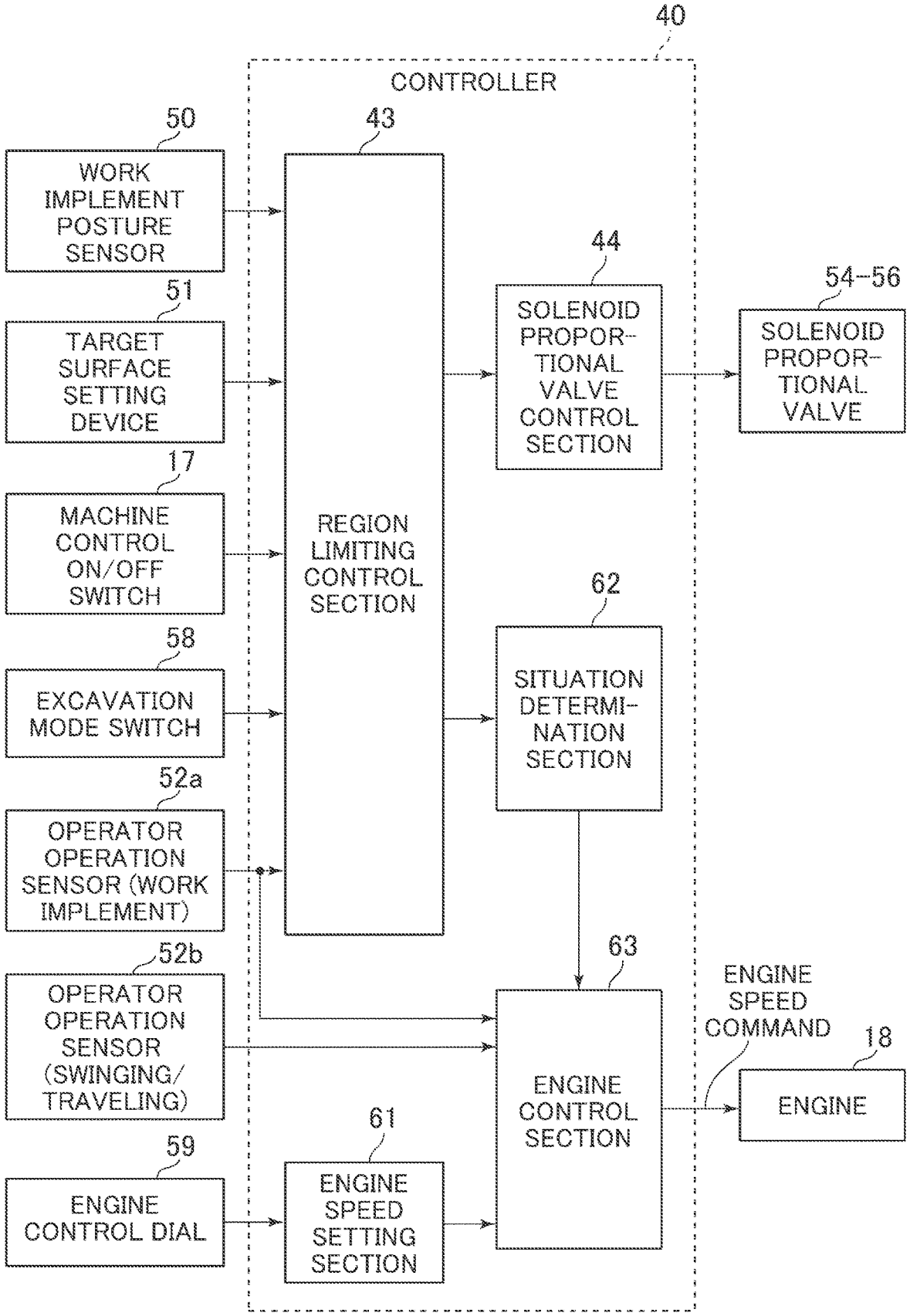
FIG. 6 is a functional block diagram illustrating the controller of the hydraulic excavator of FIG. 1.

FIG. 6 is a functional block diagram illustrating the controller 40 according to the present embodiment. The controller 40 is equipped with an area limiting control section 43, a solenoid proportional valve control section 44, an engine speed setting section 61, a situation determination section 62, and an engine control section 63.

Connected to the area limiting control section 43 are a work implement posture sensor 50, a target surface setting device 51, a machine control ON/OFF switch 17, an excavation mode switch (mode selection device) 58, and an operator operation sensor 52*a*.

The work implement posture sensor 50 is composed of a boom angle sensor 30, an arm angle sensor 31, a bucket angle sensor 32, and a machine body inclination angle sensor 33.

The target surface setting device 51 is an interface that can input information related to the target surface 60 (including positional information on each target surface and the inclination angle information). The input of the target surface via the target surface setting device 51 may be performed manually by the operator, or the target surface may be taken in from the outside via a network or the like. Connected to the target surface setting device 51 is a satellite communications antenna (not shown) such as a GNSS receiver. In the case where data communication is possible between an external terminal storing three-dimensional data of the target surface determined in a global coordinate system and the excavator, it is possible to search for a target surface corresponding to the excavator position within three-dimensional data of the external terminal and take it in based on the global coordinates of the excavator specified by the satellite communications antenna.

The operator operation sensor 52*a* is composed of pressure sensors 70*a*, 70*b*, 71*a*, 71*b*, 72*a*, and 72*b* gaining operational pressure generated in the pilot lines 144, 145, and 146 through the operation of the operation levers 1*a* and 1*b* (operation devices 45*a*, 45*b*, and 46*a*). That is, there is detected the operation with respect to the hydraulic cylinders 5, 6, and 7 related to the work implement 1A. The operator operation sensor 52*b* is composed of pressure sensors 73*a*, 73*b*, 74*a*, 74*b*, 75*a*, and 75*b* (see FIG. 2) gaining operational pressure generated in the pilot lines 147, 148, and 149 through the operation of operation levers 1*b*, 23*a*, and 23*b* (operation devices 46*b*, 47*a*, and 47*b*) by the operator. That is, there is detected the operation with respect to the hydraulic motors 3*a*, 3*b*, and 4 related to swinging and traveling.

In the present embodiment, as the excavation modes that can be selected via an excavation mode switch (mode selection device) 58, there are a "finish mode (accuracy preference mode)" and a "rough excavation mode (responsiveness preference mode)."

The finish mode is a mode in which the speed at which the work implement 1A approaches the target surface 60 at the time of excavation operation by the work implement 1A is limited. It is also called the accuracy preference mode. More specifically, it is a mode in which when, in the case where the distance between the toe of the work implement 1A and the target surface 60 is less than a predetermined value, there is generated a pilot pressure in the pilot line 145*a* through the arm crowding operation (excavation operation) by the operator via the operation device 45*b*, the solenoid proportional valve 55*a* is operated as appropriate by the controller 40 to throttle the pilot pressure, thereby deceleration-correcting the expansion speed of the arm cylinder 6. It is to be expected that this mode is selected at the time of finish operation, when a literally high control accuracy is required. In this mode, the position of the target surface 60 is the same as that when it is input from the setting device 51. When, in this way, the arm crowding speed (the expansion speed of the arm cylinder 6) is deceleration-corrected in the vicinity of the target surface to reduce the speed at which the work implement 1A approaches the target surface, the responsiveness of the work implement 1A is deteriorated. However, even when a control error is generated, the bucket toe is prevented from being erroneously allowed to get beyond the target surface at the time of the area limiting control, resulting in an improvement in terms of the control accuracy of the work implement 1A in the vicinity of the target surface. Instead of decelerating the arm cylinder 6 through the control of the solenoid proportional valve 55*a* as described above, it is also possible to set the engine speed of the engine 18 to the engine speed for the finish mode, which is relatively lower than the engine speed of the rough excavation mode, by the controller 40. Further, the capacity of the hydraulic pump 2 may be set to the capacity for the finish mode, which is relatively smaller than the capacity for the rough excavation mode, by the regulator 2*a*. While the deceleration correction of the expansion speed of the arm cylinder 6 is mentioned above, it is only necessary that the speed at which the toe of the work implement 1A approaches the target surface can be reduced. In addition to and/or instead of the deceleration correction of the expansion speed of the arm cylinder 6, the contraction speed of the boom cylinder 5 may be deceleration-corrected by the solenoid proportional valve 54*b*.

The rough excavation mode is a mode in which in the target surface computing section 43*c* in the area limiting control section 43, instead of the target surface (actual target surface) 60 set by the setting device 51, what is obtained by upwardly offsetting the target surface by a predetermined value is used as the target surface for control purpose (imaginary target surface). It is also referred to as the responsiveness preference mode. Unlike the finish mode, in this mode, the expansion speed of the arm cylinder 6 is determined in the vicinity of the target surface in accordance with the operator operation without being deceleration-corrected, and at the time of the excavation operation of the work implement 1A, the speed at which the work implement 1A approaches the imaginary target surface is not limited. Generally speaking, when the expansion speed of the arm cylinder 6 is a value in accordance with the operator operation, and priory is given to responsiveness, in the case, for example, where the arm cylinder speed is relatively high, the work implement 1A does not easily intrude under the target surface even if the forcible boom raising operation due to the area limiting control is applied. In the rough excavation mode, however, even when the responsiveness continues to be maintained, the above offset imaginary target surface is used as the target surface for control purposes, so that if intrusion of the work implement 1A into the imaginary target surface is allowed, it is possible to check the intrusion thereof into the actual target surface 60, resulting in an improvement in terms of the operational speed. The offset amount of the actual target surface 60, that is, the position of the imaginary target surface is determined such that the control error can be absorbed between the actual target surface 60 and the imaginary target surface.

Figure 7:
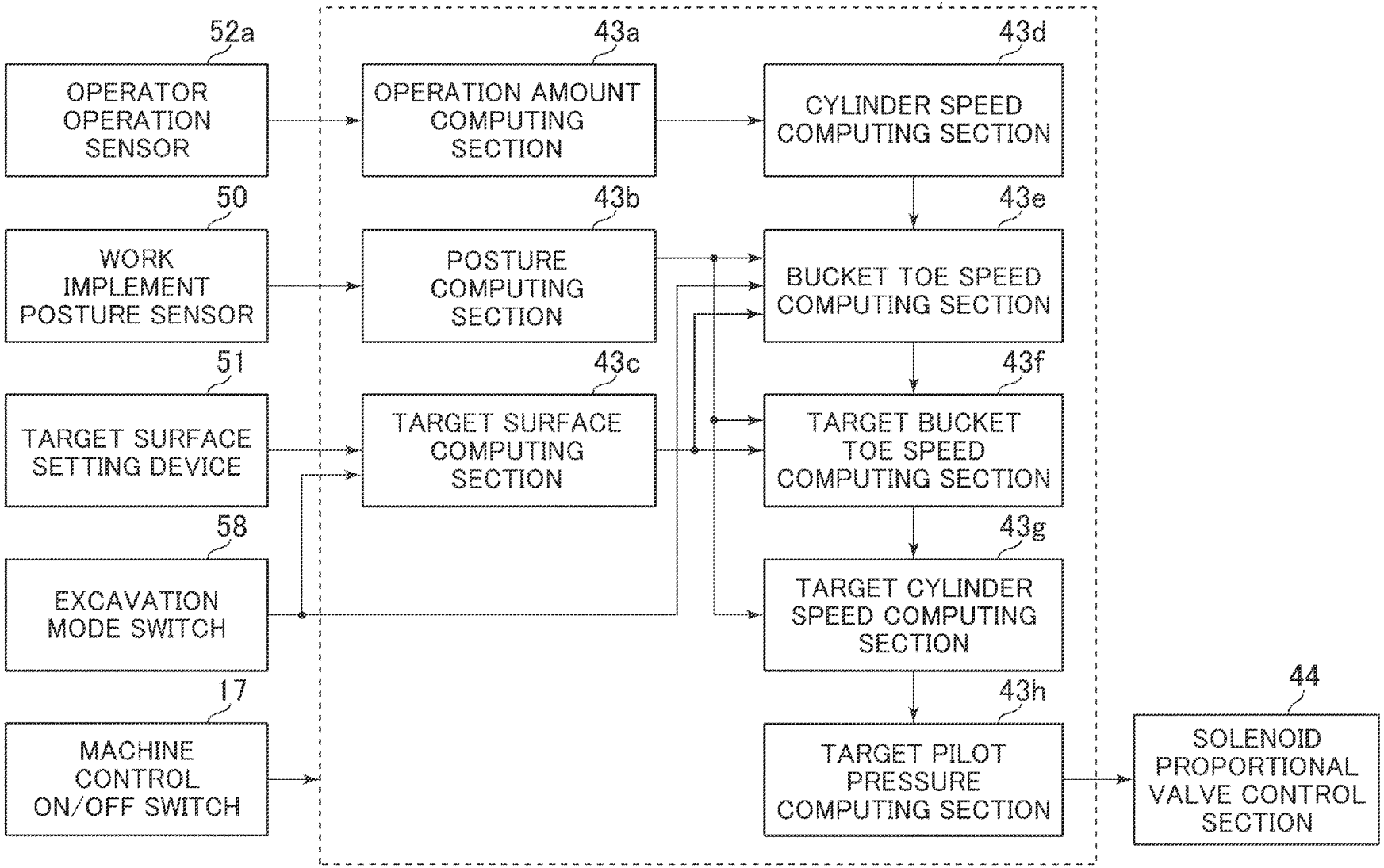
FIG. 7 is a functional block diagram illustrating a area limiting control section 43 in FIG. 6.

FIG. 7 is a functional block diagram illustrating the area limiting control section 43 in FIG. 6. The area limiting control section 43 is equipped with an operation amount computing section 43*a*, a posture computing section 43*b*, a target surface computing section 43*c*, a cylinder speed computing section 43*d*, a bucket toe speed computing section 43*e*, a target bucket toe speed computing section 43*f*, a target cylinder speed computing section 43*g*, and a target pilot pressure computing section 43*h*.

The operation amount computing section 43*a* calculates the operation amount of the operation devices 45*a*, 45*b*, and 46*a* (the operation levers 1*a* and 1*b*) based on the input from the operator operation sensor 52*a*. The operation amount of the operation devices 45*a*, 45*b*, and 46*a* can be calculated from the detection values of the pressure sensors 70, 71, and 72.

The cylinder speed computing section 43*d* computes the operational speed (cylinder speed) of the hydraulic cylinders 5, 6, and 7 based on the operation amount computed by the operation amount computing section 43*a*. The operational speed of the hydraulic cylinders 5, 6, and 7 can be calculated from the operation amount computed by the operation amount computing section 43*a*, the characteristics of the flow control valves 15*a*, 15*b*, and 15*c*, the sectional areas of the hydraulic cylinders 5, 6, and 7, the pump flow rate (delivery amount) obtained by multiplying the capacity (tilting angle) of the hydraulic pump 2 by the engine speed, etc.

The calculation of the operation amount by the pressure sensors 70, 71, and 72 is only given by way of exampled. For example, the operation amount of the operation lever may be detected by a position sensor (e.g., a rotary encoder) detecting the rotational displacement of the operation lever of each of the operation devices 45*a*, 45*b*, and 46*a*. Further, instead of the structure in which the operational speed is calculated from the operation amount, it is also possible to apply a structure in which there are mounted stroke sensors detecting expansion/contraction amounts of the hydraulic cylinders 5, 6, and 7 and in which the operational speed of each cylinder is calculated based on the time changes in the expansion/contraction amounts detected.

Figure 5:
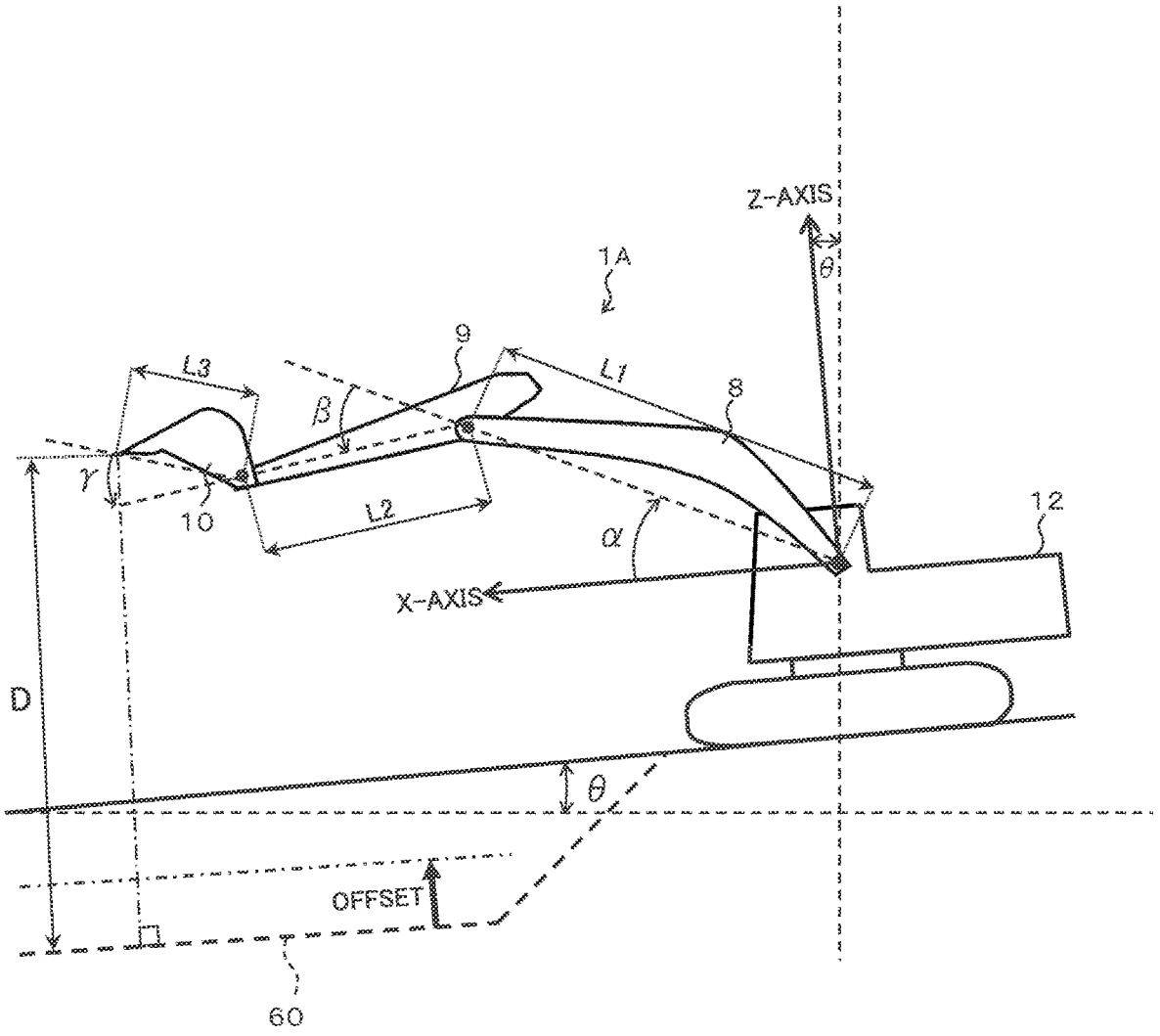
FIG. 5 is a diagram illustrating a coordinate system and a target surface in the hydraulic excavator of FIG. 1.

The posture computing section 43*b* computes the posture of the work implement 1A based on information from the work implement posture sensor 50. The posture of the work implement 1A can be defined in the excavator reference coordinates of FIG. 5. The excavator reference coordinates of FIG. 5 are coordinates set on the upper swing structure 12. The proximal portion of the boom 8 rotatably supported by the upper swing structure 12 is set as the origin, the vertical direction of the upper swing structure 12 is set as the Z-axis, and the horizontal direction thereof is set as the X-axis. The inclination angle of the boom 8 with respect to the X-axis is the boom angle $\alpha$, the inclination angle of the arm 9 with respect to the boom 8 is the arm angle $\beta$, and the inclination angle of the bucket claw tip with respect to the arm is the bucket angle $\gamma$. The inclination angle of the machine body 1B (upper swing structure 12) with respect to the horizontal plane (reference plane) is the inclination angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the inclination angle $\theta$ is detected by the machine body inclination angle sensor 33. As determined in FIG. 5, assuming that the lengths of the boom 8, the arm 9, and the bucket 10 are L1, L2, and L3 respectively, the coordinates of the bucket claw tip position in the excavator reference coordinates and the posture of the work implement 1A can be expressed by L1, L2, L3, $\alpha$, $\beta$, and $\gamma$.

Figure 9:
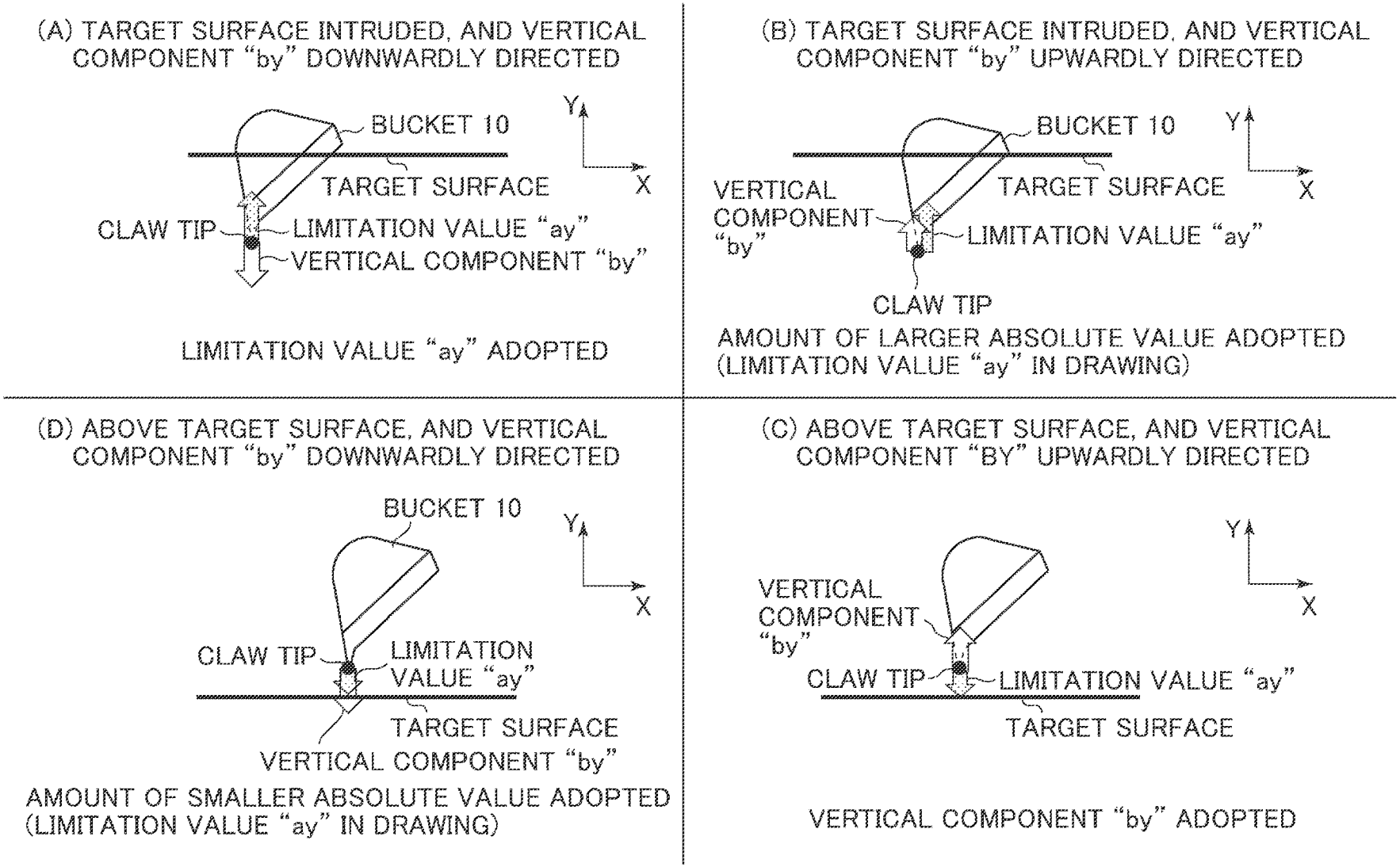
FIG. 9 is a diagram illustrating a difference in a vertical component 'cy' of a target speed vector c for each combination of the position of the claw tip with respect to the target surface and a vertical component 'by.'

The target surface computing section 43*c* computes the target surface 60 based on the information from the target surface setting device 51, and stores this in the ROM 93. As shown in FIG. 9, in the present embodiment, the sectional configuration obtained by cutting the three-dimensional target surface by a plane in which the work implement 1A moves (the operation plane of the work implement) is used as the target surface 60 (the two-dimensional target surface). Further, the target surface computing section 43*c* can switch the target surface of the object of control in accordance with the information on the switching positions of the excavation mode switch 58. The switching positions of the excavation mode switch 58 consist of a first position where the rough excavation mode is selected, and a second position where the finish mode is selected. In the case where the first position is selected, an imaginary target surface in which the target surface 60 set by the setting device 51 is upwardly offset is used as the target surface of the object of control. In the case where the second position is selected, the target surface (actual target surface 60 set by the setting device 51 is used as the target surface of the object of control.

The bucket toe speed computing section 43*e* computes the speed vector b of the bucket toe (claw tip) based on the operational speeds of the hydraulic cylinders 5, 6, and 7 computed by the cylinder speed computing section 43*d* and the posture of the work implement 1A computed by the posture computing section 43*b*. As described above, in the case where the finish mode (second position) is selected as the switching position of the excavation mode switch 58, the bucket toe speed computing section 43*e* can at least deceleration-correct the operational speed of the arm cylinder 6. Further, the bucket toe speed computing section 43*e* can resolve the speed vector b of the bucket toe into a component 'bx' horizontal to the target surface and a component 'by' vertical thereto based on the information on the target surface input from the target surface computing section 43*c*.

Figure 8:
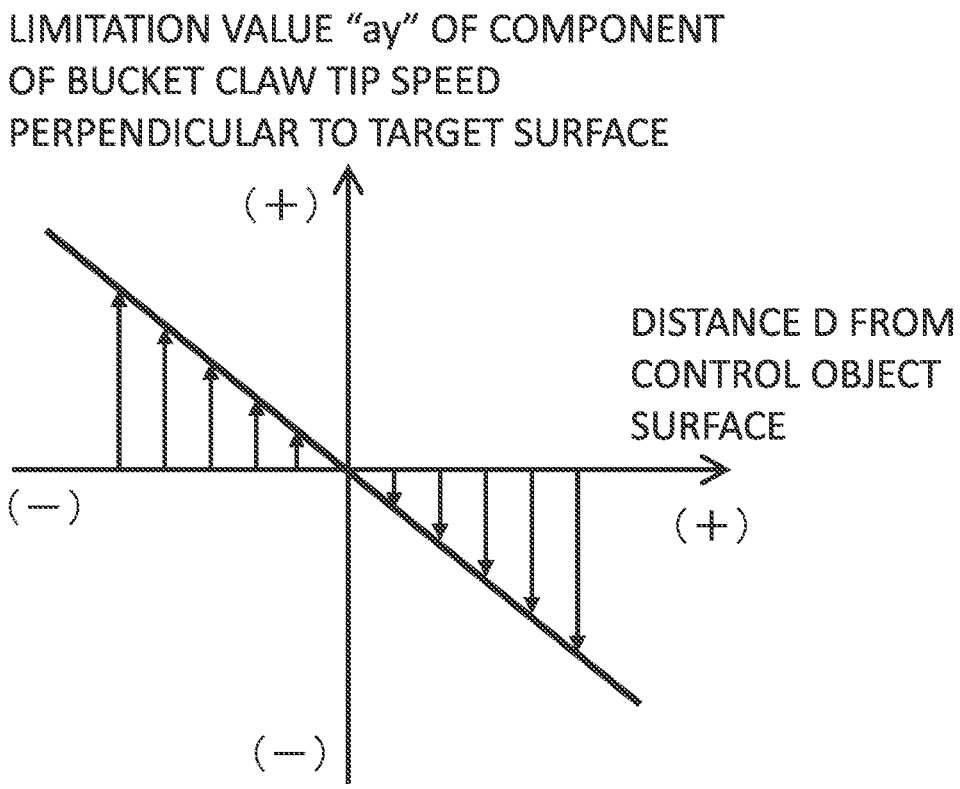
FIG. 8 is a diagram illustrating the relationship between a limitation value 'ay' of a vertical component of a bucket claw tip speed and a distance D.

The target bucket toe speed computing section 43*f* first the limitation value 'ay' of the component of the bucket toe speed vector vertical to the target surface based on the distance D from the bucket toe to the target surface of the object of control (see FIG. 5) and the graph of FIG. 8. In computing the limitation value 'ay,' a function defining the relationship between the limitation value 'ay' and the distance D as shown in FIG. 8 or a table is stored in the ROM 93 of the controller 40, and this relationship is read as appropriate. The distance D can be calculated from the position (coordinates) of the claw tip of the bucket 10 computed by the posture computing section 43*b* and the straight line including the target surface stored in the ROM 93. It is desirable for the relationship between the limitation value 'ay' and the distance D to exhibit a characteristic in which the limitation value 'ay' is monotonously reduced as the distance D increases. However, it is not limited to the one shown in FIG. 8. For example, when the distance D is not less than a positive predetermined value or not more than a negative predetermined value, the limitation value 'ay' may be maintained at an individual predetermined value, or the relationship between the limitation value 'ay' and the distance D may be defined by a curve.

Next, the target bucket toe speed computing section 43*f* computes the vertical component 'cy' of the target speed vector c of the bucket toe based on the vertical relationship between the target surface and the bucket toe, the direction of the vertical component 'by' of the speed vector of the bucket toe, the vertical component 'by' of the speed vector of the bucket toe, and the magnitude of the absolute value of the limitation value 'ay.' More specifically, as shown in FIG. 9, the vertical component 'cy' is computed through classification of cases (A) through (D). Next, the computation of the vertical component 'cy' in the cases (A) through (D) will be described.

(A) In the case where the bucket toe is below the target surface and where the vertical component 'by' computed by the computing section 43*e* is downwardly directed ((−) direction), the limitation value 'ay' (which is upwardly directed from FIG. 8) is the vertical component 'cy' (cy=ay).

(B) In the case where the bucket toe is below the target surface and where the vertical component 'by' is upwardly directed ((+) direction), the one of larger absolute value of the vertical component 'by' and the limitation value 'ay' (which is upwardly directed from FIG. 8) is the vertical component cy.

(C) In the case where the bucket toe is above the target surface and where the vertical component 'by' is downwardly directed ((−) direction), the one of smaller absolute value of the vertical component 'by' and the limitation value 'ay' (which is downwardly directed from FIG. 8) is the vertical component cy.

(D) In the case where the bucket toe is above the target surface and where the vertical component 'by' is upwardly directed ((+) direction), the vertical component 'by' (which is upwardly directed) is the vertical component 'cy' (cy=by).

In the case where the bucket toe is on the target surface 60, the limitation value 'ay' is zero, and the vertical component 'cy' is maintained at zero, so that by causing, for example, the arm 9 to perform crowding operation near the target surface 60, an excavation operation along the target surface 60 is realized by the horizontal component 'cx' of the bucket toe.

The target cylinder speed computing section 43*g* computes the target speed of each of the hydraulic cylinders 5, 6, and 7 based on the vertical component 'cy' calculated by the target bucket toe speed computing section 43*f*. In the present embodiment, in the case where the vertical component 'cy' is the limitation value 'ay' as a result of the above (A) through (D), programming is effected such that the processing of correcting the vertical component 'by' to the vertical component 'cy' (=ay) is corrected by the vertically upward component generated through forcible boom raising. Thus, the target value of the expansion speed of the boom cylinder 5 which allows correction of the vertical component 'by' to the vertical component 'cy' is uniquely determined. At this time, the target speed of the arm cylinder 6 and the bucket cylinder 7 is the value as calculated by the cylinder speed computing section 43*d* (it should be noted, however, that in the case where speed correction of the hydraulic cylinders 5, 6, and 7 including the deceleration correction of the arm cylinder 6 is executed by the bucket toe speed computing section 43*e*, the speed after the correction is the target speed). As a result, the target speed vector c of the bucket toe is a synthetic value of the speed vectors appearing at the bucket toe when the hydraulic cylinders 5, 6, and 7 are operated at the target speed.

In the case where the vertical component 'cy' is the vertical component 'by' as a result of the above (A) through (D), the target cylinder speed computing section 43*g* calculates the target speed of each of the hydraulic cylinders 5, 6, and 7 based on the speed vector b of the bucket toe calculated by the bucket toe speed computing section 43*e*.

In the case where the switching position of the machine control ON/OFF switch 17 is the ON position indicating that the area limiting control is effective, the target cylinder speed computing section 43*g* outputs the above computation result to the target pilot pressure computing section 43*h*. In the case, however, where the switching position of the machine control ON/OFF switch 17 is the OFF position indicating that the area limiting control is invalid, the target cylinder speed computing section 43*g* outputs the result of the computation result of the cylinder speed computing section 43*d* to the target pilot pressure computing section 43*h*.

The target pilot pressure computing section 43*h* computes the target pilot pressure to the flow control valves 15*a*, 15*b*, and 15*c* of the hydraulic cylinders 5, 6, and 7 based on the target speed of the cylinders 5, 6, and 7 calculated by the target cylinder speed computing section 43*g*.

The solenoid proportional valve control section 44 computes the command to each of the solenoid proportional valves 54 through 56 based on the target pilot pressure to the flow control valves 15*a*, 15*b*, and 15*c* calculated by the target pilot pressure computing section 43*h*. In the case where the pilot pressure based on the operator operation and the target pilot pressure calculated by the target pilot pressure computing section 43*h* coincide with each other, the electric current value (command value) to the corresponding one of the solenoid proportional valves 54 through 56 is zero, and the operation of the corresponding one of the solenoid proportional valves 54 through 56 is not conducted.

In the area limiting control section 43 and the solenoid proportional valve control section 44 constructed as described above, in the case where horizontal excavation is conducted through drawing operation of the arm 9 through the operation of the operation lever 1 by the operator, when there is a fear of the bucket toe intruding under the target surface 60, the solenoid proportional valve 54*a* is controlled and the operation of raising the boom 8 is automatically performed, so that it is possible to realize an excavation operation along the target surface 60 independently of the skill of the operator. Further, when the finish mode is selected by the excavation mode switch 58, the expansion speed of the arm cylinder 6 is reduced by the solenoid proportional valve 55*a*, whereby it is possible to achieve an improvement in terms of excavation accuracy. In order that the angle of the back surface of the bucket 10 with respect to the target surface 60 may be of a fixed value to facilitate the leveling work, the solenoid proportional valve 56*d* may be controlled such that the bucket 10 automatically rotates in the damping direction.

Referring back to FIG. 6, the situation determination section 62 is a section determining whether or not the low engine speed control (automatic idling control) by the engine control section 63 is to be executed based on the information input to the area limiting control section 43 and/or the information calculated by the area limiting control section 43. The determination will be specifically described below with reference to a flowchart.

The engine speed setting section 61 is a section controlling the target engine speed of the engine 18 in the case where the low engine speed control (automatic idling control) by the engine control section 63 is not conducted (which is sometimes referred to as the "control engine speed" in the present specification). As the control engine speed, the set engine speed of the engine control dial 59 is utilized in principle. In some cases, however, a engine speed determined through other control is utilized in preference to the set revolving speed. As the "engine speed determined through other control," various engine speeds are available, an example of which is the engine speed controlled for the purpose of raising a low hydraulic fluid temperature and the engine cooling water temperature through warming-up. Further, there are a engine speed controlled in accordance with operational load for the sake of energy saving, and a engine speed controlled in accordance with an arbitrarily selected operation mode (e.g., energy saving mode, power mode, and heavy load mode).

The engine control section 63 generates an engine speed command with the control engine speed input from the engine speed setting section 61 serving as the target engine speed in principle, and outputs the command to control the engine speed of the engine 18 to the control engine speed. Input to the engine control section 63 are signals from the operator operation sensors 52*a* and 52*b* and the situation determination section 62 apart from the engine seed setting section 61. Based on the signals from the sensors 52*a* and 52*b* and the situation determination section 62, the engine control section 63 determines whether or not a predetermined period of time has elapsed from the point in time when all the operation levers 1*a*, 1*b*, 23*a*, and 23*b* have attained a neutral state (first determination), and, based on the situation determination section 62, determines whether or not low engine speed control (automatic idling control) is to be executed (second determination) at a predetermined control cycle during the operation of the engine 18.

In the case where the second determination is of the result that "the low engine speed control (automatic idling control) should not be executed," independently of the result of the first determination, the engine control section 63 does not execute the low engine speed control (automatic idling control) in which the target engine speed of the engine speed 18 is turned into a low engine speed (automatic idling engine speed) lower than the control engine speed instead of the control engine speed.

In the case where the second determination is of the result that "the low engine speed control (automatic idling control) should be executed," the engine control section 63 executes, when a predetermined period of time has elapsed from the point in time when, in the first determination, all the operation levers 1*a*, 1*b*, 23*a*, and 23*b* have attained the neutral state, the low engine speed control (automatic idling control) in which the target engine speed of the engine speed 18 is turned into a low engine speed (automatic idling engine speed) lower than the control engine speed instead of the control engine speed. When the engine speed is thus controlled, it is possible to reduce the engine speed from the control engine speed to the low engine speed automatically when the operation lever is not operated, so that it is possible to avoid surplus fuel consumption and achieve an energy saving effect.

Figure 10:
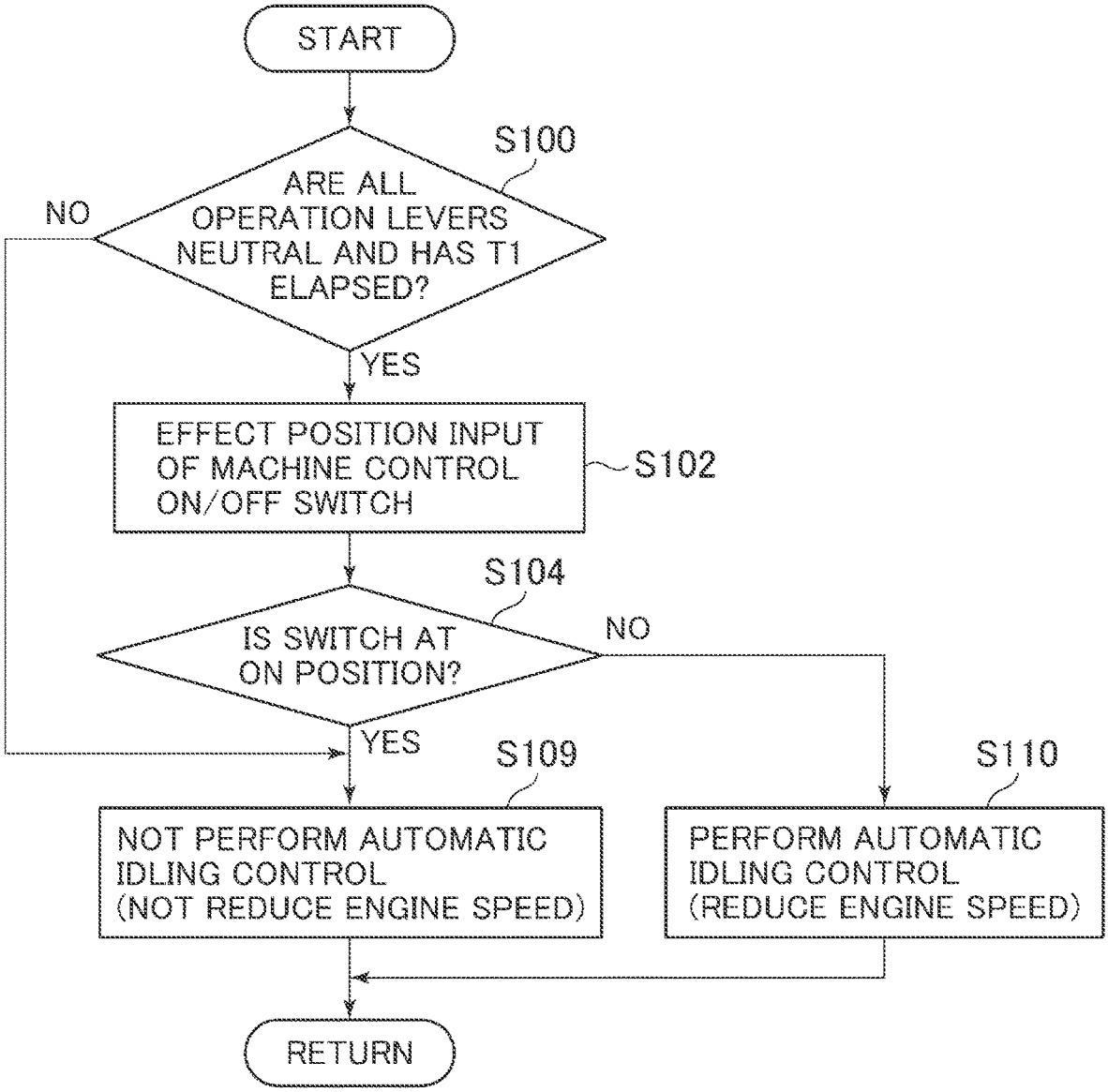
FIG. 10 is a flowchart illustrating automatic idling control processing executed by a controller according to a first embodiment.

Next, the processing executed by the situation determination section 62 and the engine control section 63 in the present embodiment will be described in detail with reference to FIG. 10. FIG. 10 is a flowchart illustrating the automatic idling control processing executed by the controller 40 according to the first embodiment. The controller 40 starts the flowchart of FIG. 10 with the control cycle for checking the necessity of the execution of the automatic idling control by the engine control section 63.

First, in S100, the engine control section 63 determines whether or not a predetermined period of time T1 or more has elapsed from the point in time when all of the operation levers 1*a*, 1*b*, 23*a*, and 23*b* have attained a neutral state. The measurement of the time is conducted by a timer function with which the engine control section 63 is equipped, and the period of time that has elapsed from the point in time when all the operation levers have become neutral is measured by the timer. When it is determined in S110 that the time T1 or more has elapsed since all the operation levers 1 and 23 have attained the neutral state, the procedure advances to S102. On the other hand, when it is determined that the time T1 has not elapsed since all the operation levers 1 and 23 have attained the neutral state (in the case where at least one of the operation levers 1 and 23 is being operated or where the state in which all the operation levers 1 and 23 are neutral has lasted for less than T1), the procedure advances to S109 described below.

In S102, the situation determination section 62 inputs a signal from the machine control ON/OFF switch 17 via the area limiting control section 43, and checks the switching position of the switch 17. In S104, it is determined whether the area limiting control is effective or invalid based on the switching position of the switch 17 input in S102. In the case where it is verified that the switching position of the switch 17 is at the ON position, there is the possibility of control accuracy being required of the area limiting control by the area limiting control section 43, and it is determined that the automatic idling control should not be executed, with the procedure advancing to S109. On the other hand, in the case where it is verified that the switching position of the switch 17 is at the OFF position, there is no possibility of control accuracy being required of the area limiting control, and it is determined that the automatic idling control should be executed, with the procedure advancing to S110.

In S109, the engine control section 63 does not execute the automatic idling control, and the target engine speed is set to the control engine speed set by the engine speed setting section 61, with the procedure returning to START. As a result, even if the time T1 has elapsed from the point in time when all the plurality of operation levers 1*a*, 1*b*, 23*a*, and 23*b* have attained the neutral state, the automatic idling control is not executed. In the case where at least one of the operation levers 1 and 23 is operated during the execution of the automatic idling control, the automatic idling control is canceled. In the case where transition is directly effected from S100 to S109, the automatic idling control is to be canceled, and the timer measurement time is reset to zero.

In S110, the engine control section 63 executes or continues the automatic idling control in which the control engine speed is forcibly reduced to the low engine speed, and the procedure returns to START.

As described above, in the present embodiment, there is provided a hydraulic excavator 1 including: an engine 18; a hydraulic pump 2 driven by the engine 18; a multi-joint type work implement 1A; a plurality of hydraulic actuators 5, 6, and 7 driving the work implement 1A by a hydraulic working fluid delivered from the hydraulic pump 2; and a controller 40 which has an area limiting control section 43 which when excavation operation is input from the operator via a plurality of operation levers 1*a* and 1*b*, performs area limiting control to control the plurality of hydraulic actuators 5, 6, and 7 such that an operational range of the work implement 1A is limited to an area on a predetermined target surface 60 and an area above the target surface 60, in which there is provided in the hydraulic excavator 1 a machine control ON/OFF switch 17 alternatively selecting between an ON position (permission position) where execution of the area limiting control by the area limiting control section 43 is permitted and an OFF position (prohibition position) where execution of the area limiting control by the area limiting control section 43 is prohibited; the controller 40 is equipped with a plurality of operation levers 1*a* and 1*b* outputting operation signals to the plurality of hydraulic actuators 5, 6, and 7 an engine control section 63 which when a predetermined period of time T1 has elapsed from a point in time when all the plurality of operation levers 1*a*, 1*b*, 23*a*, and 23*b* have attained a neutral state, performs an automatic idling control (low engine speed control) to make the engine speed of the engine 18 a low engine speed that is smaller than a control engine speed; and in a case where the switching 17 is switched to the OFF position, the engine control section 63 (controller 40) executes the automatic idling control when the predetermined period of time T1 has elapsed from the point in time when all the plurality of operation levers 1*a*, 1*b*, 23*a*, and 23*b* have attained a neutral state, and in a case where the switch 17 is switched to the ON position, the engine control section does not execute the automatic idling control even when the predetermined period of time T1 has elapsed from the point in time when all the plurality of operation levers 1*a*, 1*b*, 23*a*, and 23*b* have attained a neutral state.

In the hydraulic excavator constructed as described above, while the machine control ON/OFF switch 17 is at the ON position, the automatic idling control is not executed altogether independently of whether or not the finishing operation of which high control accuracy is actually conducted as the area limiting control. Thus, in the case where the finishing operation due to the area limiting control is executed with the resuming of the operation, it is possible to prevent the speed of the hydraulic cylinder from being changed, making it possible to maintain the control accuracy of the work implement 1A at the time of area limiting control. As a result, it is possible to maintain the control of the work implement toe along the target surface, so that it is possible to maintain the accuracy of the target surface formed by the work implement 1A.

Second Embodiment

The second embodiment of the present invention will be described. The hardware configuration is the same as that of the first embodiment, so a description thereof will be left out. The processing executed in the present embodiment by the situation determination section 62 and the engine control section 63 will be described in detail with reference to FIG. 11.

Figure 11:
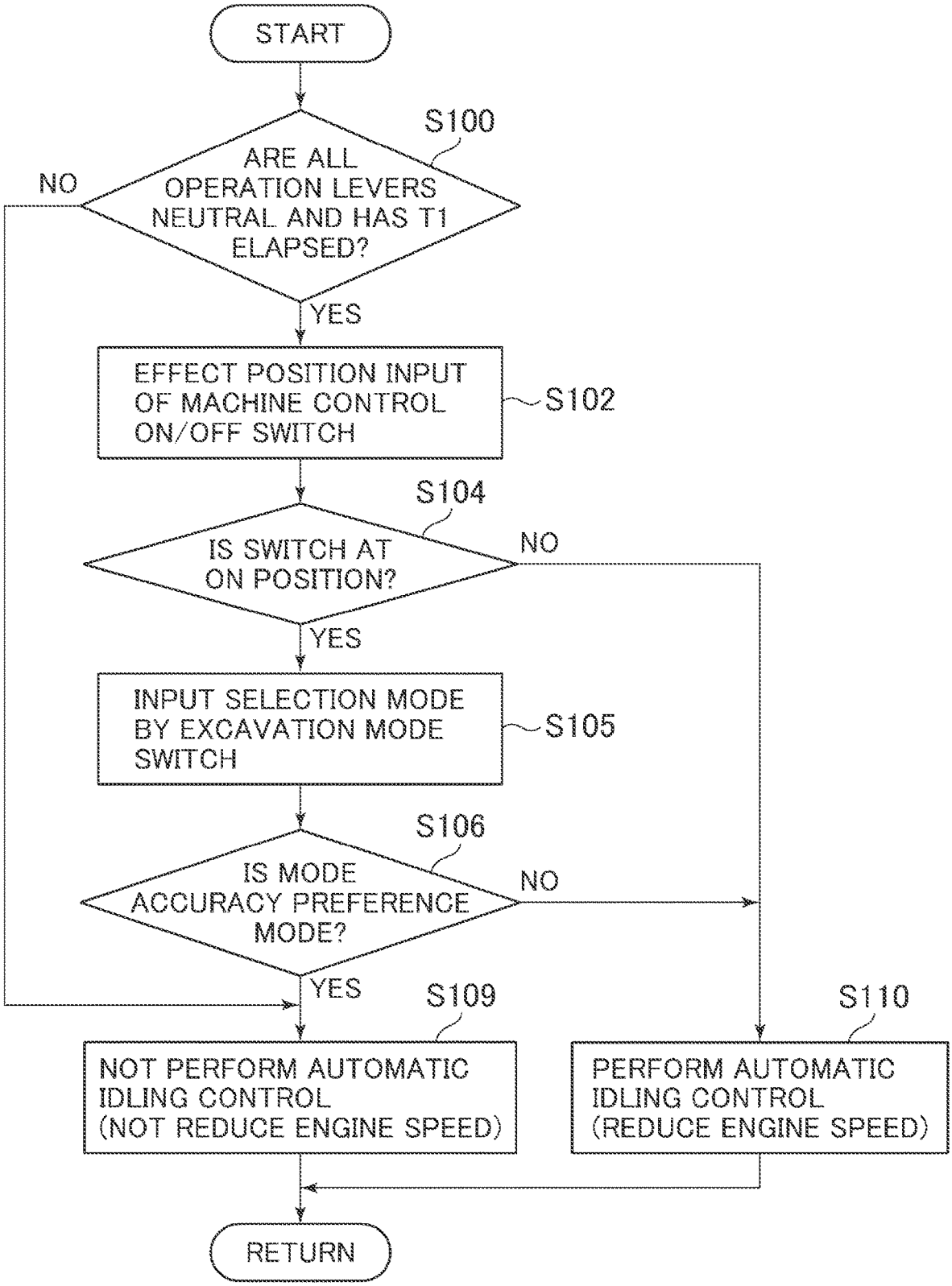
FIG. 11 is a flowchart illustrating automatic idling control processing executed by a controller according to a second embodiment.

FIG. 11 is a flowchart illustrating the automatic idling control processing executed by the controller 40 according to the second embodiment. The same processing as that of the preceding drawing is indicated by the same reference numeral, and a description thereof will be left out.

In S105, the situation determination section 62 inputs a signal from the excavation mode switch 58 via the area limiting control section 43, and checks the mode selected by the switch 58.

In S106, based on the information input in S105, it is determined whether the selection mode of the switch 58 is the finishing mode (accuracy preference mode). In the case where it is made sure that the selection mode of the switch 58 is the finishing mode (accuracy preference mode), there is the high possibility of the finishing work being executed through the area limiting control of the area limiting control section 43, and it is determined that the automatic idling control should not be executed, and the procedure advances to S109, with the engine control section 63 performing no automatic idling control. On the other hand, in the case where it is made sure that the selection mode of the switch 58 is the rough excavation mode (responsiveness preference mode), there is the low possibility of the finishing work being executed through the area limiting control of the area limiting control section 43, and it is determined that the automatic idling control should be executed, with the procedure advancing to S110. The engine control section 63 conducts the automatic idling control.

As described above, in the present embodiment, in addition to the structure of the first embodiment, the hydraulic excavator 1 is equipped with the excavation mode switch 58 capable of selecting as the control mode of the area limiting control one of the following modes: the finishing mode (accuracy preference mode) in which the speed at which the work implement 1A approaches the target surface 60 is limited, and the rough excavation mode (responsiveness preference mode) in which a target surface (imaginary target surface) obtained by upwardly offsetting the target surface 60 by a predetermined value is used as the target surface during the area limiting control and in which the speed at which the work implement 1A approaches the imaginary target surface is not limited. When the finishing mode is selected by the switch 58, the engine control section 63 (controller 40), does not execute the automatic idling control even if the predetermined period of time T1 has elapsed from the point in time when all of the plurality of operation levers 1*a*, 1*b*, 23*a*, and 23*b* have attained the neutral state with the machine control ON/OFF switch 17 being at the ON position. When the rough excavation mode is selected by the switch 58, the engine control section 63 (controller 40)

executes the automatic idling control when the predetermined period of time T1 has elapsed from the point in time when all of the plurality of operation levers 1*a*, 1*b*, 23*a*, and 23*b* have attained the neutral state with the machine control ON/OFF switch 17 being at the ON position.

In the hydraulic excavator constructed as described above, even if the machine control ON/OFF switch 17 is at the ON position, in the case where the rough excavation mode (responsiveness preference mode) is selected by the excavation mode switch 58, the automatic idling control is executed when the predetermined period of time T1 has elapsed from the point in time when all of the plurality of operation levers 1*a*, 1*b*, 23*a*, and 23*b* have attained the neutral state, so that even if the machine control ON/OFF switch 17 is at the ON position, it is possible to reduce the fuel consumption amount of the hydraulic excavator 1. That is, even if the machine control ON/OFF switch 17 is at the ON position, it is possible to reduce the fuel consumption amount, so that a fuel consumption amount reducing effect that is higher than that in the first embodiment is to be expected.

S102 and S104 may be omitted from the flowchart of FIG. 11. That is, the processing from S105 onward may be performed without checking the position of the machine control ON/OFF switch 17. Further, while in the above embodiment it is only the rough excavation mode (responsiveness preference mode) that can be selected by the excavation mode switch 58 other than the finishing mode (accuracy preference mode), the present embodiment is also applicable to a case where other modes are set as the control mode of the area limiting control and where the other modes can be selected by the switch 58. That is, the present embodiment is also applicable to the case where the excavation mode switch 58 is constructed such that alternative selection of at least one other mode is possible in addition to the finishing mode (accuracy preference mode) and the finishing mode.

Third Embodiment

The third embodiment of the present invention will be described. The hardware configuration is the same as that of the first embodiment, so a description thereof will be left out. The processing executed by the situation determination section 62 and the engine control section 63 in the present embodiment will be described in detail with reference to FIG. 12.

Figure 12:
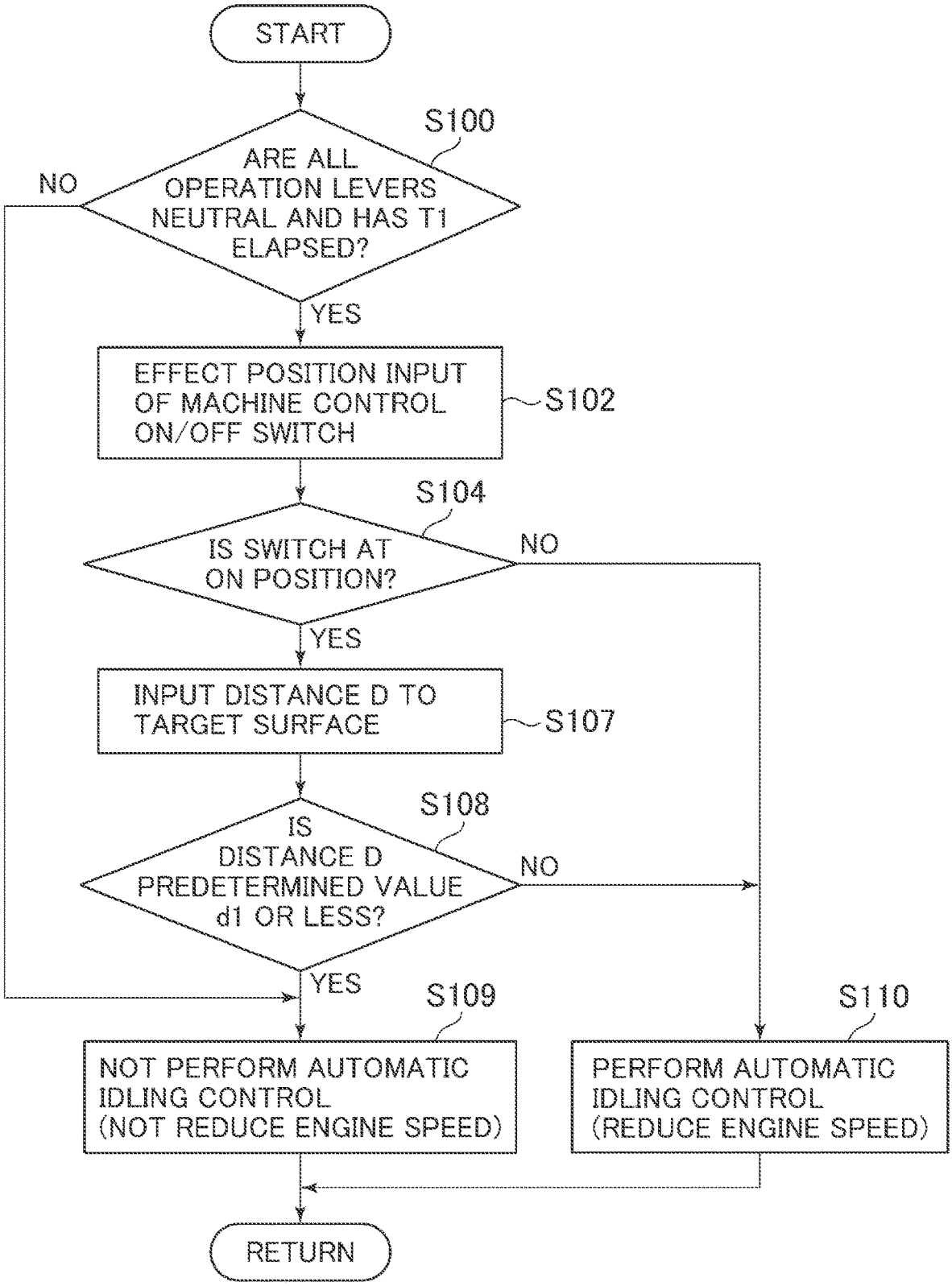
FIG. 12 is a flowchart illustrating automatic idling control processing executed by a controller according to a third embodiment.

FIG. 12 is a flowchart illustrating the automatic idling control processing executed by the controller 40 according to the third embodiment. The processing that is the same as that of the preceding drawing is indicated by the same reference numeral, and a description thereof will be left out.

In S107, the situation determination section 62 inputs, from the area limiting control section 43, the distance D from the bucket toe to the target surface of the object of control calculated from the computation result of the posture computing section 43*b* and the target surface computing section 43*c*.

In S108, it is determined whether or not the distance D input in S107 is a predetermined value d1 or less. In the case where it is made sure that the distance D is the predetermined value d1 or less, there is the high possibility of the finishing work being executed through the area limiting control of the area limiting control section 43, and it is determined that the automatic idling control should not be executed, with the procedure advancing to S109. The engine control section 63 conducts no automatic idling control. On the other hand, in the case where it is made sure that the distance D exceeds the predetermined value d1, there is the low possibility of the finishing work being executed through the area limiting control, and it is determined that the automatic idling control should be executed, with the procedure advancing to S110. The engine control section 63 conducts the automatic idling control.

As described above, when the distance D exceeds the predetermined value d1, the engine control section 63 (controller 40) of the present embodiment executes the automatic idling control when the predetermined period of time T1 elapses from the point in time when all of the plurality of operation levers 1*a*, 1*b*, 23*a*, and 23*b* have attained the neutral state with the machine control ON/OFF switch 17 being at the ON position. When the distance D is the predetermined value d1 or less, the engine control section 63 does not execute the automatic idling control even when the predetermined period of time T1 has elapsed from the point in time when all of the plurality of operation levers 1*a*, 1*b*, 23*a*, and 23*b* have attained the neutral state with the machine control ON/OFF switch 17 being at the ON position.

In the hydraulic excavator constructed as described above, even if the machine control ON/OFF switch 17 is at the ON position, in the cases where the distance D is the predetermined value d1 or less, the automatic idling control is executed when the predetermined period of time T1 has elapsed from the point in time when all of the plurality of operation levers 1*a*, 1*b*, 23*a*, and 23*b* have attained the neutral state, so that even if the machine control ON/OFF switch 17 is at the ON position, it is possible to reduce the fuel consumption amount of the hydraulic excavator 1 even if the machine control ON/OFF switch 17 is at the ON position. That is, it is possible to reduce the fuel consumption amount even if the machine control ON/OFF switch 17 is at the ON position, so that a fuel consumption amount reducing effect higher than that of the first embodiment is to be expected. Further, in the control of the second embodiment, when the finishing mode (control preference mode) is erroneously selected during rough excavation, there is the possibility of the automatic idling control being unnecessarily prohibited even when the distance D to the target surface D is sufficient and the automatic idling control is possible from the situational point of view, whereas, in the present embodiment, the presence/absence of the execution of the automatic idling control is determined based on the distance D, so that the fuel consumption amount can be reduced even in the case where the finishing mode is erroneously selected.

Regarding the determination of the predetermined value d1, in the case there exists an upper limit value (d2) of the distance D at which the area limiting control is executed, setting may be made such that d1=d2 (d2 is a positive value). In this case, the area limiting control is not executed if the distance D is d2 or more. Or, if it is executed, it is only necessary for the rough excavation to be possible, so that even if the automatic idling control is executed, no problem in terms of control accuracy is involved at the time of restoring from the control. More specifically, in the case where the nature of the graph of FIG. 8 is such that the limitation value 'ay' is not set within the range in which the distance D is the predetermined value d2 or more (e.g., the case where the limitation value 'ay' is infinity when D≥d2, or the case where the limitation value 'ay' exceeds the theoretical maximum value of the vertical component 'by' when D≥d2), and setting can be made such that d1=d2. In the case where the upper limit value (d3) of the distance D of which high control accuracy can be required for the area limiting control can be determined, setting may be made such that d1=d3. Examples of the upper limit value d3 include the offset amount from the actual target surface 60 of the imaginary target surface in the rough excavation mode.

As in the second embodiment, S102 and S104 may be omitted from the flowchart of FIG. 12. That is, it is possible to perform the processing from S107 onward without checking the position of the machine control ON/OFF switch 17.

ADDITIONAL REMARK

While in the example described above the target surface is a straight line, the target surface may also be defined by connecting together a plurality of segments.

While in the above embodiments the automatic idling control is started by the engine control section 63 when the state in which the four operation levers 1*a*, 1*b*, 23*a*, and 23*b* are in the neutral state has continued for the predetermined time T1 or more, it is also possible to adopt a structure in which the automatic idling control is started when the two operation levers 1*a* and 1*b* mainly operating the work implement 1A are in the neutral state has continued for the period of time T1 or more.

In the above description, the three factors of the position of the switch 17, the selection mode of the mode switch 58, and the distance D are given by way of example as the grounds for determining by the situation determination section 62 whether or not the automatic idling control (low engine speed control) is to be executed by the engine control section 63, it is also possible to utilize other indexes so long as they allow the determination whether or not the automatic idling control is to be executed.

While in the above-description the finishing work is taken as an example of the case where high control accuracy is required of the area limiting control, this should not be construed restrictively. The above embodiments are applicable to any other case so long as it requires high control accuracy of machine control.

In the above-described embodiments the signals of the machine control ON/OFF switch 17 and the excavation mode switch 58 are input to the situation determination section 62 via the area limiting control section 43 (see, for example, FIG. 6). It is also possible, however, to construct the controller 40 such that the signals of the machine control ON/OFF switch 17 and the excavation mode switch 58 are directly input the situation determination section 62 not via the area limiting control section 43, and to perform the control of FIGS. 10 through 12.

The present invention is not limited to the above embodiments but includes various modifications without departing from the scope of the gist of the invention. For example, the present invention is not limited to a structure equipped with all the components described in connection with the above embodiments but also includes a structure from which some components are partially deleted. Further, a part of the structure of a certain embodiment can be added to or replaced by the structure of another embodiment.

DESCRIPTION OF REFERENCE CHARACTERS

1A: Front work implement
8: Boom
9: Arm
10: Bucket
17: Machine control ON/OFF switch
30: Boom angle sensor
31: Arm angle sensor
32: Bucket angle sensor
40: Controller
43: Area limiting control section
44: Solenoid proportional valve control section
45: Operation device (boom arm)
46: Operation device (bucket swing)
47: Operation device (traveling)
50: Work implement posture sensor
51: Target surface setting device
52*a*, 52*b*: Operator operation sensor
54, 55, 56: Solenoid proportional valve
58: Excavation mode switch
59: Engine control dial
61: Engine speed setting section
62: Situation determination section
63: Engine control section

The invention claimed is:

1. A hydraulic excavator comprising:

an engine;

a hydraulic pump driven by the engine;

a multi-joint work implement;

a plurality of hydraulic actuators driving the work implement by a hydraulic working fluid delivered from the hydraulic pump;

a plurality of operation levers outputting operation signals to the plurality of hydraulic actuators;

an engine control dial in which a desired engine speed is input by an operator as a control engine speed; and a controller which is configured to control an engine speed of the engine at the control engine speed input to the engine control dial, execute low engine speed control to make the engine speed of the engine a low engine speed that is lower than the control engine speed input to the engine control dial when a predetermined period of time has elapsed from a point in time when all of the plurality of operation levers have attained a neutral state, and execute area limiting control of the plurality of hydraulic actuators such that an operational range of the work implement is limited to an area on a predetermined target surface and an area above the predetermined target surface, wherein the hydraulic excavator further comprises a machine control ON/OFF switch which selects between an ON position where execution of the area limiting control by the controller is permitted and an OFF position where execution of the area limiting control is prohibited, in a case where the predetermined period of time or more has elapsed from the point in time when all of the plurality of operation levers have attained the neutral state and where the area limiting control is prohibited by switching the machine control ON/OFF switch to the OFF position, the controller is further configured to execute the low engine speed control, thereby controlling the engine speed of the engine at the low engine speed, in a case where the predetermined period of time or more has elapsed from the point in time when all of the plurality of operation levers have attained the neutral state and where the area limiting control is permitted by switching the machine control ON/OFF switch to the ON position, the controller is further configured to not execute the low engine speed control and control the engine speed of the engine at the control engine speed, and in the case where at least one operation lever of the plurality of operation levers is operated or in a case where the predetermined period of time or more has not yet elapsed from the point in time when all of the plurality of operation levers have attained the neutral state, the controller is further configured not to execute the low engine speed control and control the engine speed of the engine at the control engine speed.

2. A hydraulic excavator comprising:

an engine;

a hydraulic pump driven by the engine;

a multi-joint work implement;

a plurality of hydraulic actuators driving the work implement by a hydraulic working fluid delivered from the hydraulic pump;

a plurality of operation levers outputting operation signals to the plurality of hydraulic actuators;

an engine control dial in which a desired engine speed is input by an operator as a control engine speed; and a controller which is configured to control an engine speed of the engine at the control engine speed input to the engine control dial, execute low engine speed control to make the engine speed of the engine a low engine speed that is lower than the control engine speed input to the engine control dial when a predetermined period of time has elapsed from a point in time when all of the plurality of operation levers have attained a neutral state, and execute area limiting control of the plurality of hydraulic actuators such that an operational range of the work implement is limited to an area on a predetermined target surface and an area above the predetermined target surface, the hydraulic excavator further comprising:

a machine control ON/OFF switch which selects between an ON position where execution of the area limiting control by the controller is permitted and an OFF position where execution of the area limiting control is prohibited; and an excavation mode switch which selects, as a control mode for the area limiting control, one of an accuracy preference mode in which a speed at which the work implement approaches the predetermined target surface is limited and a responsiveness preference mode in which an offset target surface obtained by upwardly offsetting the predetermined target surface by a predetermined value is used as the target surface during the area limiting control and in which the speed at which the work implement approaches the offset target surface is not limited, wherein in a case where the predetermined period of time or more has elapsed from the point in time when all of the plurality of operation levers have attained the neutral state and where the machine control ON/OFF switch is switched to the OFF position, the controller is further configured to execute the low engine speed control, thereby controlling the engine speed of the engine at the low engine speed, in a case where the predetermined period of time or more has elapsed from the point in time when all of the plurality of operation levers have attained the neutral state and where the machine control ON/OFF switch is switched to the ON position and where the accuracy preference mode is selected by the excavation mode switch, the controller is further configured to not execute the low engine speed control and control the engine speed of the engine at the control engine speed, in a case where the predetermined period of time or more has elapsed from the point in time when all of the plurality of operation levers have attained the neutral state and where the machine control ON/OFF switch is switched to the ON position and where the responsiveness preference mode is selected by the excavation mode switch, the controller is further configured to execute the low engine speed control, thereby controlling the engine speed of the engine at the low engine speed, and in case where at least one operation lever of the plurality of operation levers is operated or in a case where the predetermined period of time or more has not yet elapsed from the point in time when all of the plurality of operation levers have attained the neutral state, the controller is further configured not to execute the low engine speed control and control the engine speed of the engine at the control engine speed.

3. A hydraulic excavator comprising:

an engine;

a hydraulic pump driven by the engine;

a multi-joint work implement;

a plurality of hydraulic actuators driving the work implement by a hydraulic working fluid delivered from the hydraulic pump;

a plurality of operation levers outputting operation signals to the plurality of hydraulic actuators;

an engine control dial in which a desired engine speed is input by an operator as a control engine speed; and a controller which is configured to control an engine speed of the engine at the control engine speed input to the engine control dial, execute low engine speed control to make the engine speed of the engine a low engine speed that is lower than the control engine speed input to the engine control dial when a predetermined period of time has elapsed from a point in time when all of the plurality of operation levers have attained a neutral state, and execute area limiting control of the plurality of hydraulic actuators such that an operational range of the work implement is limited to an area on a predetermined target surface and an area above the predetermined target surface, wherein the hydraulic excavator further comprises a machine control ON/OFF switch which selects between an ON position where execution of the area limiting control by the controller is permitted and an OFF position where execution of the area limiting control is prohibited, in a case where the predetermined period of time or more has elapsed from the point in time when all of the plurality of operation levers have attained the neutral state and where the machine control ON/OFF switch is switched to the OFF position, the controller is further configured to executes the low engine speed control, thereby controlling the engine speed of the engine at the low engine speed, in a case where the predetermined period of time or more has elapsed from the point in time when all of the plurality of operation levers have attained the neutral state and where the machine control ON/OFF switch is switched to the ON position and where distance between the work implement and the predetermined target surface exceeds a predetermined value, the controller is further configured to executes the low engine speed control, thereby controlling the engine speed of the engine at the low engine speed, in a case where the predetermined period of time or more has elapsed from the point in time when all of the plurality of operation levers have attained the neutral state and where the machine control ON/OFF switch is switched to the ON position and where the distance between the work implement and the predetermined target surface is the predetermined value or less, the controller is further configured to not execute the low engine speed control and control the engine speed of the engine at the control engine speed, and in a case where at least one operation lever of the plurality of operation levers is operated or in a case where the predetermined period of time or more has not yet elapsed from the point in time when all of the plurality of operation levers have attained the neutral state, the controller is further configured not to execute the low engine speed control and control the engine speed of the engine at the control engine speed.

* * * * *